US010625513B2

(12) United States Patent
Sato et al.

(10) Patent No.: US 10,625,513 B2
(45) Date of Patent: Apr. 21, 2020

(54) LIQUID DISCHARGE DEVICE AND METHOD OF CONTROLLING THE SAME

(71) Applicant: SEIKO EPSON CORPORATION, Tokyo (JP)

(72) Inventors: Masahiko Sato, Matsumoto (JP); Hisashi Sato, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/129,617

(22) Filed: Sep. 12, 2018

(65) Prior Publication Data

US 2019/0077163 A1 Mar. 14, 2019

(30) Foreign Application Priority Data

Sep. 13, 2017 (JP) ..... 2017-175722

(51) Int. Cl.
*B41J 2/175* (2006.01)
*B41J 2/14* (2006.01)
*B41J 2/165* (2006.01)

(52) U.S. Cl.
CPC ..... *B41J 2/17596* (2013.01); *B41J 2/14233* (2013.01); *B41J 2/16508* (2013.01); *B41J 2/16517* (2013.01); *B41J 2/16526* (2013.01); *B41J 2/17509* (2013.01); *B41J 2002/16597* (2013.01)

(58) Field of Classification Search
CPC .. B41J 2/1652; B41J 2/16526; B41J 2/16532; B41J 2002/16594; B41J 2002/16597; B41J 2/17596
See application file for complete search history.

(56) References Cited

U.S. PATENT DOCUMENTS

2009/0219320 A1* 9/2009 Shimizu ..... B41J 2/055 347/14

FOREIGN PATENT DOCUMENTS

| | | | |
|---|---|---|---|
| JP | 09-174875 | A | 7/1997 |
| JP | 2002-052737 | A | 2/2002 |
| JP | 2007-118539 | A | 6/2007 |
| JP | 2008-105352 | A | 5/2008 |

* cited by examiner

*Primary Examiner* — Julian D Huffman
(74) *Attorney, Agent, or Firm* — Workman Nydegger

(57) ABSTRACT

In a method of controlling a liquid discharge device, the liquid discharge device includes a liquid discharge unit and at least one valve body. The liquid discharge unit discharges from a nozzle liquid supplied from at least one supply channel. The at least one valve body opens/closes the at least one supply channel. The method includes first control and second control. The first control causes a pressure to be applied to the liquid so as to supply the liquid to the at least one supply channel. The second control causes an external force to operate the at least one valve body operable in accordance with a pressure on a downstream side of the at least one valve body so as to adjust and hold a degree of opening of the at least one valve body in a range between a closed state and a full-open state.

10 Claims, 12 Drawing Sheets

FIG. 8

| CASE | PRESSURE OF PUMP [kPa] | DEGREE OF OPENING OF SOLENOID VALVE | | | | SUPPLY PRESSURE OF INK [kPa] | | | |
|---|---|---|---|---|---|---|---|---|---|
| | V0 | V1 | V2 | V3 | V4 | S1 | S2 | S3 | S4 |
| 1 | 10 | 1 | 1 | 1 | 1 | 10 | 10 | 10 | 10 |
| 2 | 20 | 1 | 1 | 1 | 1 | 20 | 20 | 20 | 20 |
| 3 | 30 | 1 | 1 | 1 | 1 | 30 | 30 | 30 | 30 |

FIG. 9

| CASE | PRESSURE OF PUMP [kPa] | DEGREE OF OPENING OF SOLENOID VALVE | | | | SUPPLY PRESSURE OF INK [kPa] | | | |
|---|---|---|---|---|---|---|---|---|---|
| | V0 | V1 | V2 | V3 | V4 | S1 | S2 | S3 | S4 |
| 4 | 20 | 1/2 | 0 | 0 | 0 | 10 | 0 | 0 | 0 |
| 5 | 20 | 1/2 | 1 | 1 | 1 | 10 | 20 | 20 | 20 |
| 6 | 30 | 1/3 | 0 | 0 | 0 | 10 | 0 | 0 | 0 |
| 7 | 30 | 1/3 | 2/3 | 1 | 1 | 10 | 20 | 30 | 30 |

FIG. 16

| CASE | ROTATIONAL ANGLE OF ECCENTRIC CAM | | | | SUPPLY PRESSURE OF INK [kPa] | | | |
|---|---|---|---|---|---|---|---|---|
| | M1 | M2 | M3 | M4 | S1 | S2 | S3 | S4 |
| 1 | 1/3 | 0 | 0 | 0 | 10 | 0 | 0 | 0 |
| 2 | 1/3 | 2/3 | 1 | 1 | 10 | 20 | 30 | 30 |

LIQUID DISCHARGE DEVICE AND METHOD OF CONTROLLING THE SAME

This application claims priority to Japanese Patent Application No. 2017-175722 filed on Sep. 13, 2017. The entire disclosure of Japanese Patent Application No. 2017-175722 is incorporated herein by reference.

BACKGROUND

1. Technical Field

The present invention relates to techniques with which liquid such as ink is discharged.

2. Related Art

In liquid discharge devices in which liquid such as ink is discharged from a nozzle of a liquid discharge unit, in order to sufficiently supply the liquid to the liquid discharge unit through a supply channel, a pressure is applied to the liquid in a liquid container to supply the liquid to the supply channel. For example, according to techniques described in JP-A-2002-52737, when a pressure is applied to the inside of a liquid container with air from an air pump to supply liquid to a supply channel, insufficient supply of the liquid is suppressed by varying the pressure of the air pump between time of printing and time of cleaning.

SUMMARY

However, in the case where the pressure of the liquid is adjusted on the upstream side of the supply channel as in JP-A-2002-52737, when a valve body operable in accordance with the pressure on the downstream side is provided in the supply channel, pressure adjustment is easily influenced by variation in pressure loss in the supply channel due to operation of the valve body such as a response of the valve body. Thus, variation in supply pressure of the liquid to the liquid discharge unit is likely to increase. This increases difficulty in fine adjustment, with high accuracy, of the supply pressure of the liquid to the liquid discharge unit. Accordingly, an advantage of some aspects of the invention is to improve accuracy in adjustment of the supply pressure of liquid.

In order to address the above-described problem, according to an aspect of the invention, in a method of controlling a liquid discharge device, the liquid discharge device includes a liquid discharge unit and at least one valve body. The liquid discharge unit discharges from a nozzle liquid supplied from at least one supply channel. The at least one valve body opens/closes the at least one supply channel. The method includes first control and second control. The first control causes a pressure to be applied to the liquid so as to supply the liquid to the at least one supply channel. The second control causes an external force to operate the at least one valve body operable in accordance with a pressure on a downstream side of the at least one valve body so as to arbitrarily adjust and hold a degree of opening of the at least one valve body in a range between a closed state and a full-open state. With the above-described form, the pressure is applied to the liquid so as to supply the liquid to the at least one supply channel under the first control, and, under the second control, the degree of opening of the at least one valve body is arbitrarily adjusted and held in a range between the closed state and the full-open state by the operation of the at least one valve body caused by the external force, so that a supply pressure of this liquid supplied to the liquid discharge unit can be arbitrarily adjusted. Furthermore, the at least one valve body operable in accordance with the pressure on the downstream side of the at least one valve body is forcibly operated by the external force, thereby the pressure of the liquid flowing through the at least one supply channel is adjusted. Thus, compared to the case where the pressure is adjusted on the upstream side of the at least one supply channel, it is unlikely that the pressure adjustment is influenced by variation in pressure loss. This allows fine adjustment of the pressure of the liquid supplied to the liquid discharge unit, and accordingly, accuracy in adjustment of the supply pressure of the liquid can be improved.

It is preferable that the at least one supply channel include a plurality of supply channels, the at least one valve body include a plurality of valve bodies, and each of the plurality of valve bodies be provided for a corresponding one of the plurality of supply channels. In this case, the first control is separately performed on each of the plurality of supply channels, and the second control is separately performed on each of the plurality of supply channels. With the above-described form, the liquid discharge device has the plurality of supply channels, and each of the plurality of valve bodies is provided for a corresponding one of the plurality of supply channels. The first control is separately performed on each of the plurality of supply channels, and the second control is separately performed on each of the plurality of supply channels. Thus, the supply pressure of the liquid can be finely adjusted for each of the supply channels with high accuracy.

It is preferable that the second control for the plurality of valve bodies be simultaneously performed. With the above-described form, the second control for the plurality of valve bodies are simultaneously performed. Thus, compared to the case where the second control is serially performed on the different valve bodies at different times, a period of time taken to perform the second control on the plurality of valve bodies can be reduced.

It is preferable that the external force in the second control be a pressure of air applied by a pump, and, in the second control, the degrees of opening of the plurality of valve bodies be separately adjusted by varying the pressure of the pump in accordance with respective target values of supply pressures of the liquid. With the above-described form, in the second control, the degrees of opening of the plurality of valve bodies are adjusted by varying the pressure of the pump in accordance with the respective target values of the supply pressures of the liquid. This can suppress an excessive increase of the pressure of the pump. Thus, a period of time taken for the pressure of the air applied by the pump to increase so as to increase the supply pressure of the liquid to the target values can be reduced, and accordingly, the burden on the pump can be reduced.

It is preferable that a common air channel be connected to the pump, branch air channels respectively corresponding to the plurality of valve bodies be branched from the common air channel, and each of the branch air channels be provided with a corresponding one of solenoid valves. It is also preferable that, in the second control, the solenoid valves each adjust the pressure applied by the pump for a corresponding one of the branch air channels so as to adjust the degree of opening of a corresponding one of the plurality of valve bodies. With the above-described form, in the second control, the solenoid valves each adjust the pressure applied by the pump for a corresponding one of the branch air channels so as to adjust the degree of opening of a corresponding one of the plurality of valve bodies. Accordingly, even when a low-performance pump with low pressure accuracy is used, the degrees of opening of the plurality of valve bodies can be adjusted. This can improve accuracy in adjustment of the supply pressure of the liquid.

It is preferable that a buffer chamber be provided in the common air channel. In this case, it is preferable that the second control include closing the solenoid valves and driving the pump so as to store the pressure of the air in the buffer chamber and opening the solenoid valves so as to adjust the degrees of opening of the plurality of valve bodies by the pressure of the air stored in the buffer chamber. With the above-described form, the degrees of opening of the plurality of valve bodies are adjusted by the pressure of the air stored in the buffer chamber. Accordingly, even when a low-performance pump of low pressure is used, the degrees of opening of the plurality of valve bodies can be adjusted. This can improve accuracy in adjustment of the supply pressure of the liquid.

It is preferable that the liquid discharge device further include a flexible film that operates the at least one valve body. In this case, it is preferable that the flexible film have a first surface that defines a portion of the at least one supply channel downstream of the at least one valve body and a second surface opposite to the first surface, and the at least one valve body operable by deformation of the flexible film occurring in accordance with a differential pressure between a pressure on the first surface side and a pressure on the second surface side be caused to be operated by deformation of the flexible film occurring due to an external force applied from the second surface side. With the above-described form, the flexible film can be forcibly deformed due to the external force from the second surface side. Thus, the at least one valve body can be operated independently of the differential pressure between the pressure on the first surface side and the pressure on the second surface side. This allows fine adjustment of the pressure of the liquid without being influenced by the differential pressure, and accordingly, accuracy in adjustment of the supply pressure of the liquid can be improved.

In order to address the above-described problem, according to another aspect of the invention, a liquid discharge device includes a liquid discharge unit, at least one valve body, a pressure supplier (e.g. a pressure mechanism), and a holder (e.g. a holding mechanism). The liquid discharge unit discharges from a nozzle liquid supplied from at least one supply channel. The at least one valve body opens/closes the at least one supply channel. The pressure mechanism applies a pressure to the liquid so as to supply the liquid to the at least one supply channel. The holding mechanism causes an external force to operate the at least one valve body operable in accordance with a pressure on a downstream side of the at least one valve body so as to arbitrarily adjust and hold a degree of opening of the at least one valve body in a range between a closed state and a full-open state. With the above-described form, the pressure is applied to the liquid so as to supply the liquid to the at least one supply channel, and, the degree of opening of the at least one valve body is arbitrarily adjusted and held in a range between the closed state and the full-open state by the operation of the at least one valve body caused by the external force, so that a supply pressure of this liquid supplied to the liquid discharge unit can be arbitrarily adjusted. Furthermore, the at least one valve body operable in accordance with the pressure on the downstream side of the at least one valve body is forcibly operated by the external force, thereby the pressure of the liquid flowing through the at least one supply channel is adjusted. Thus, compared to the case where the pressure is adjusted on the upstream side of the at least one supply channel, it is unlikely that the pressure adjustment is influenced by variation in pressure loss. This allows fine adjustment of the pressure of the liquid supplied to the liquid discharge unit, and accordingly, accuracy in adjustment of the supply pressure of the liquid can be improved.

It is preferable that the at least one supply channel include a plurality of supply channels, the at least one valve body include a plurality of valve bodies, each of the plurality of valve bodies be provided for a corresponding one of the plurality of supply channels, and the holding mechanism arbitrarily adjust and hold the degrees of opening of the plurality of valve bodies separately for the respective supply channels. With the above-described form, the at least one supply channel includes a plurality of supply channels, each of the plurality of valve bodies is provided for a corresponding one of the plurality of supply channels, and the holding mechanism arbitrarily adjusts and holds the degrees of opening of the plurality of valve bodies separately for the respective supply channels. Thus, the supply pressure of the liquid can be finely adjusted for each of the supply channels with high accuracy.

It is preferable that the external force be a pressure of air applied by a pump provided in the holding mechanism, and the holding mechanism separately adjust the degrees of opening of the plurality of valve bodies by varying the pressure of the pump in accordance with respective target values of the supply pressures of the liquid. With the above-described form, the external force is a pressure of air applied by a pump provided in the holding mechanism, and the holding mechanism separately adjusts the degrees of opening of the plurality of valve bodies by varying the pressure of the pump in accordance with the respective target values of the supply pressures of the liquid. This can suppress an excessive increase of the pressure of the pump. Thus, a period of time taken for the pressure of the air applied by the pump to increase so as to increase the supply pressure of the liquid to the target values can be reduced, and accordingly, the burden on the pump can be reduced.

It is preferable that a common air channel be connected to the pump, branch air channels respectively corresponding to the plurality of valve bodies be branched from the common air channel, and each of the branch air channels be provided with a corresponding one of solenoid valves. It is also preferable that the holding mechanism adjust the pressure applied by the pump for each of the branch air channels by using a corresponding one of the solenoid valves so as to adjust the degree of opening of a corresponding one of the plurality of valve bodies. With the above-described form, the holding mechanism causes each of the solenoid valves to adjust the pressure applied by the pump for a corresponding one of the branch air channels so as to adjust the degree of opening of a corresponding one of the plurality of valve bodies. Accordingly, even when a low-performance pump with low pressure accuracy is used, the degrees of opening of the plurality of valve bodies can be adjusted. This can improve accuracy in adjustment of the supply pressure of the liquid.

It is preferable that the common air channel have a buffer chamber that temporarily stores the pressure of the air applied by the pump. With the above-described form, the common air channel have a buffer chamber that temporarily stores the pressure of the air applied by the pump. This allows the degrees of opening of the plurality of valve bodies to be adjusted by the pressure of the air stored in the buffer chamber. Accordingly, even when a low-performance pump of low pressure is used, the degrees of opening of the plurality of valve bodies can be adjusted. This can improve accuracy in adjustment of the supply pressure of the liquid.

It is preferable that the liquid discharge device further include a flexible film that operates the at least one valve body. In this case, it is preferable that the flexible film have a first surface that defines a portion of the at least one supply channel downstream of the at least one valve body and a second surface opposite to the first surface, and the holding mechanism cause the at least one valve body operable by deformation of the flexible film occurring in accordance with a differential pressure between a pressure on the first surface side and a pressure on the second surface side to be operated by deformation of the flexible film occurring due to an external force applied from the second surface side. With the above-described form, the flexible film can be forcibly deformed due to the external force from the second surface side. Thus, the at least one valve body can be operated independently of the differential pressure between the pressure on the first surface side and the pressure on the second surface side. This allows fine adjustment of the pressure of the liquid without being influenced by the differential pressure, and accordingly, accuracy in adjustment of the supply pressure of the liquid can be improved.

BRIEF DESCRIPTION OF THE DRAWINGS

The invention will be described with reference to the accompanying drawings, wherein like numbers reference like elements.

FIG. 8 is a specific example illustrating the relationships between the pressure of a pump, the degrees of opening of solenoid valves, and supply pressures of the ink.

FIG. 9 is another specific example illustrating the relationships between the pressure of the pump, the degrees of opening of the solenoid valves, and the supply pressures of the ink.

FIG. 16 is a specific example illustrating the relationships between the rotational angles of eccentric cams and the supply pressures of the ink.

DESCRIPTION OF EXEMPLARY EMBODIMENTS

First Embodiment

Figure 1:
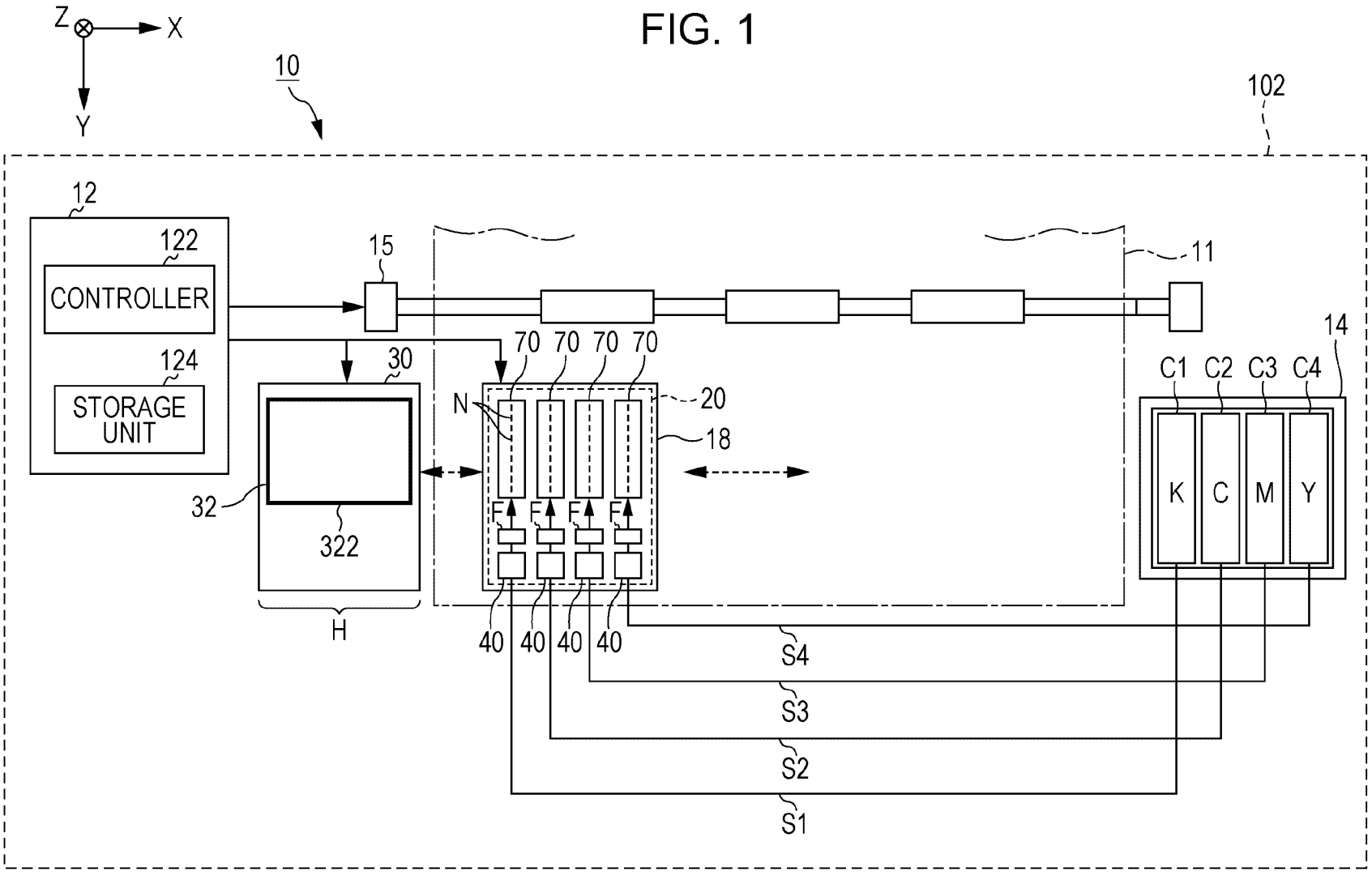
FIG. 1 illustrates the structure of a liquid discharge device according to a first embodiment.

FIG. 1 illustrates the structure of part of a liquid discharge device 10 according to a first embodiment of the invention. The liquid discharge device 10 according to the present embodiment is an ink jet printer in which an ink exemplifying liquid is discharged toward a medium 11 such as a sheet of printing paper. The liquid discharge device 10 illustrated in FIG. 1 includes a substantially box-shaped apparatus main body 102. A control unit 12, a transport mechanism 15, a liquid discharge head 20, a carriage 18, and a maintenance unit 30 are provided in the apparatus main body 102.

A mounting portion 14 (cartridge holder), in which a plurality of liquid containers C1 to C4 (cartridges) are mountable is provided in the apparatus main body 102. The liquid containers C1 to C4 each contain a corresponding one of a plurality of types of ink. The ink is liquid (color ink) containing pigments, colorant, or the like. For example, each type of the ink is liquid of a corresponding one of four colors, that is, black (K), cyan (C), magenta (M), and yellow (Y). The liquid containers C1 to C4 according to the present embodiment respectively contain black (K) ink, cyan (C) ink, magenta (M) ink, and yellow (Y) ink.

The liquid containers C1 to C4 are ink tank-type cartridges that are box-shaped containers removably mountable in the mounting portion 14. The liquid containers C1 to C4 are not limited to box-shaped containers and may be ink pack-type cartridges including bag-shaped containers. A plurality of supply channels S1 to S4, through which the ink is supplied to the liquid discharge head 20, are provided in the apparatus main body 102. In the present embodiment, an example in which four supply channels S1 to S4 each correspond to a corresponding one of four liquid containers C1 to C4 is described. Each of the supply channels S1 to S4 connects a corresponding one of the liquid containers C1 to C4 to the liquid discharge head 20. The ink in the liquid containers C1 to C4 is fed by pressure to the liquid discharge head 20 through the respective supply channels S1 to S4.

The control unit 12 includes a controller 122 and a storage unit 124. The controller 122 is, for example, a central processing unit (CPU), a field programmable gate array (FPGA), or the like. The storage unit 124 is, for example, a semiconductor memory. Elements of the liquid discharge device 10 are collectively controlled when a control program store in the storage unit 124 is executed by the controller 122. As illustrated in FIG. 1, print data indicative of an image to be formed on the medium 11 is supplied from an external device (not illustrated) such as a host computer to the control unit 12. The control unit 12 controls the elements of the liquid discharge device 10 so that the image specified by the print data is formed on the medium 11.

The transport mechanism 15 transports the medium 11 in the Y direction under the control of the control unit 12. The liquid discharge head 20 discharges ink from a plurality of nozzles N toward the medium 11 under the control of the control unit 12. The liquid discharge head 20 is mounted on the carriage 18. The control unit 12 causes the carriage 18 to reciprocate in the X direction intersecting the Y direction. When printing is performed, the liquid discharge head 20 discharges the ink toward the medium 11 in parallel with the transport of the medium 11 by the transport mechanism 15 and reciprocation repeatedly performed by the carriage 18. Thus, a desired image is formed on the surface of the medium 11. A direction perpendicular to the X-Y plane (plane parallel to the surface of the medium 11) is represented as "Z direction".

The liquid discharge head 20 includes a plurality of liquid discharge units 70. In an example illustrated in FIG. 1, four liquid discharge units 70 corresponding to four liquid containers C1 to C4 are arranged in the X direction perpendicular to the Y direction in which the medium 11 is transported. Four liquid discharge units 70 are each connected to a downstream side of a corresponding one of the supply channels S1 to S4. A plurality of nozzle rows are formed in discharge surfaces (surfaces facing the medium 11) of the liquid discharge units 70. Each of the nozzle rows is a set of the nozzles N arranged along a line in the Y direction. Although an example in which a single nozzle row is formed in each of fourth liquid discharge units 70 is described, the numbers of the liquid discharge units 70 and the nozzle rows are not limited those in the illustrated example.

Figure 2:
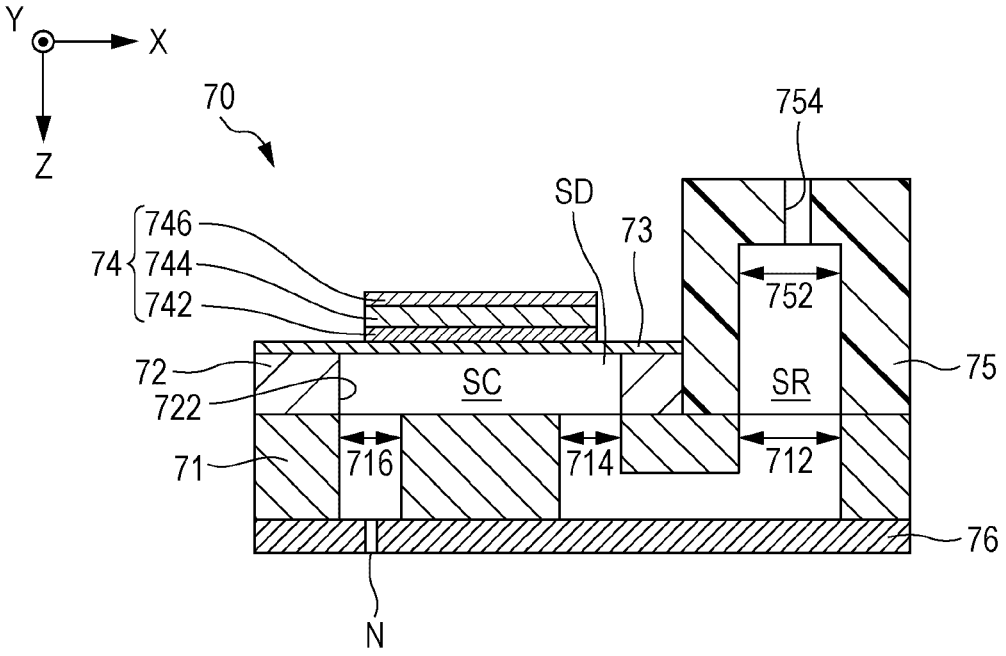
FIG. 2 is a sectional view of a liquid discharge unit.

FIG. 2 is a sectional view focusing on one of nozzles N of any one of the liquid discharge units 70. As illustrated in FIG. 2, the liquid discharge unit 70 is a structural body in which a pressure-chamber substrate 72, vibrating plates 73, piezoelectric elements 74, and a support 75 are disposed on one side of a channel substrate 71, and a nozzle plate 76 is disposed on the other side of the channel substrate 71. The channel substrate 71, the pressure-chamber substrate 72, and the nozzle plate 76 are each formed of, for example, a silicon flat-plate, and the support 75 is formed by, for example, injection molding a resin material. The plurality of nozzles N are formed in the nozzle plate 76.

The channel substrate 71 has an opening 712, branch channels 714, and communication channels 716. Each of the branch channels 714 and each of the communication channels 716, which are through holes, are formed for a corresponding one of the nozzles N. The opening 712 is a single continuous opening for the plurality of nozzles N. A containing portion 752 (recess) formed in the support 75 and the opening 712 of the channel substrate 71 communicate with each other to form a space. This space functions as a common liquid chamber SR (reservoir) in which the ink supplied through an introducing channel 754 of the support 75 is stored.

The pressure-chamber substrate 72 has openings 722. Each of the openings 722 is provided for a corresponding one of the nozzles N. The vibrating plates 73 are elastically deformable flat plates disposed on the opposite surface of the pressure-chamber substrate 72 to the channel substrate 71. A space that is formed in each of the openings 722 of the pressure-chamber substrate 72 and interposed between a corresponding one of the vibrating plates 73 and the channel substrate 71 functions as a pressure chamber SC (cavity) to be filled with the ink supplied from the common liquid chamber SR through a corresponding one of the branch channels 714. The pressure chamber SC communicates with the nozzle N through a corresponding one of the communication channels 716 of the channel substrate 71. The pressure chambers SC, the common liquid chamber SR, the opening 712 and the branch channels 714 communicating with the pressure chambers SC and the common liquid chamber SR, and the communication channels 716 form a space. This space is included in an inner space SD of the liquid discharge head 20.

The piezoelectric elements 74 are formed for the respective nozzles N on the opposite surface of the vibrating plates 73 to the pressure-chamber substrate 72. Each of the piezoelectric elements 74 is a drive element (pressure generating element) in which a piezoelectric material 744 is interposed between a first electrode 742 and a second electrode 746. A drive signal is supplied to one of the first electrode 742 and the second electrode 746, and a specified reference potential is supplied to the other. When the drive signal is supplied, the piezoelectric element 74 is deformed. This causes the vibrating plate 73 to vibrate, thereby varying the pressure in the pressure chamber SC. As a result, the ink in the pressure chamber SC is discharged from the nozzle N. Specifically, the ink in an amount corresponding to the amplitude of the drive signal is discharged from the nozzle N. The structure of the piezoelectric element 74 is not limited to the above description.

The maintenance unit 30 is disposed, for example, in a non-printing region H, which is a home position (standby position) of the carriage 18 in the X direction. The maintenance unit 30 performs maintenance processing on the liquid discharge head 20 when the carriage 18 is positioned at the non-printing region H. The maintenance unit 30 includes a capping mechanism 32 controlled by the control unit 12.

The capping mechanism 32 is used to cap a discharge surface of the liquid discharge head 20. The capping mechanism 32 includes a cap 322 that closes the nozzles N in the discharge surface. The cap 322 has a box shape having an opening on the negative side in the Z direction. By bringing an opening edge portion of the cap 322 into contact with the discharge surface, the nozzles N in the discharge surface are closed. The cap 322 is movable by a motor (not illustrated) in the Z direction. The cap 322 is moved toward the negative side in the Z direction so as to be brought into contact with the discharge surface and toward the positive side in the Z direction so as to be separated from the discharge surface.

The control unit 12 causes the cap 322 to be brought into contact with the discharge surface to close the nozzles N. At this time, pressure is applied to the ink so as to supply the ink to the liquid discharge head 20 through the supply channels S1 to S4, thereby thickened ink and bubbles can be discharged from the nozzles N to the cap 322 (pressure cleaning). This can suppress clogging or discharge failure of the nozzles N. The ink discharged to the cap 322 is collected in a waste liquid tank (not illustrated) through a channel communicating with the cap 322.

Figure 3:
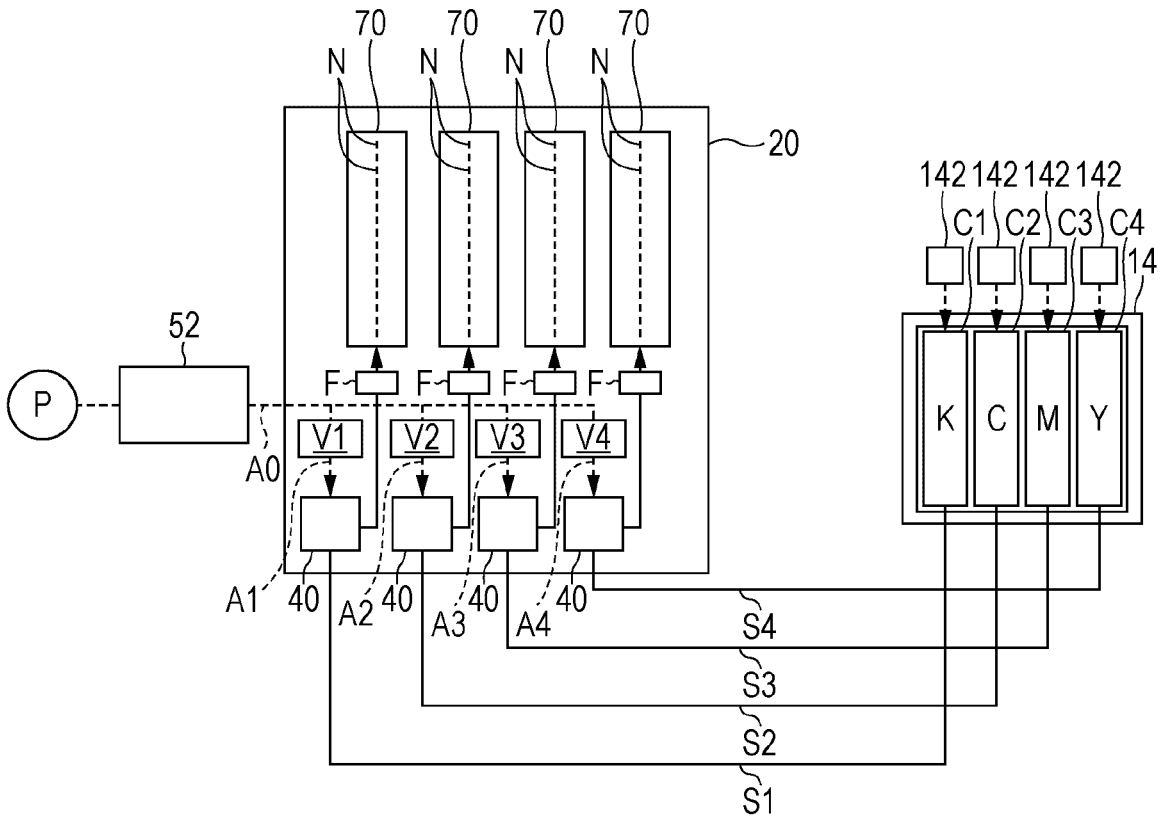
FIG. 3 illustrates the structure of supply channels for ink.

FIG. 3 illustrates the structure of the supply channels S1 to S4 for the ink according to the first embodiment. As illustrated in FIG. 3, the liquid containers C1 to C4 are respectively connected to upstream sides of the supply channels S1 to S4. The liquid discharge units 70 are respectively connected to downstream sides of the supply channels S1 to S4. Pressure mechanisms 142 are respectively connected to the liquid containers C1 to C4. The pressure mechanisms 142 apply pressure to the ink so as to feed (pump) the ink. The pressure mechanisms 142 according to the present embodiment include air pumps. The insides of the liquid containers C1 to C4 are pressurized by the air from the air pumps, thereby the ink in the liquid containers C1 to C4 is pumped to the introducing channels 754 of the respective liquid discharge units 70 through the respective supply channels S1 to S4.

The pressure mechanisms 142 are not limited to the air pumps. The pressure mechanisms 142 may be liquid feed pumps provided downstream of the liquid containers C1 to C4 or may be elevation mechanisms that move up and down the liquid containers C1 to C4 so as to adjust hydraulic head pressures of the ink in the liquid containers C1 to C4. Thus, the ink in the liquid containers C1 to C4 is pressurized to specified pressures and supplied to the respective liquid discharge units 70 through the supply channels S1 to S4.

The supply channels S1 to S4 according to the present embodiment are each provided with a corresponding one of valve devices 40 (self closing valves). Filter units F are interposed between the valve devices 40 of the supply channels S1 to S4 and the respective liquid discharge units 70. The filter units F are provided with filters (not illustrated) that trap bubbles and foreign matter having entered the supply channels S1 to S4.

Figure 4:
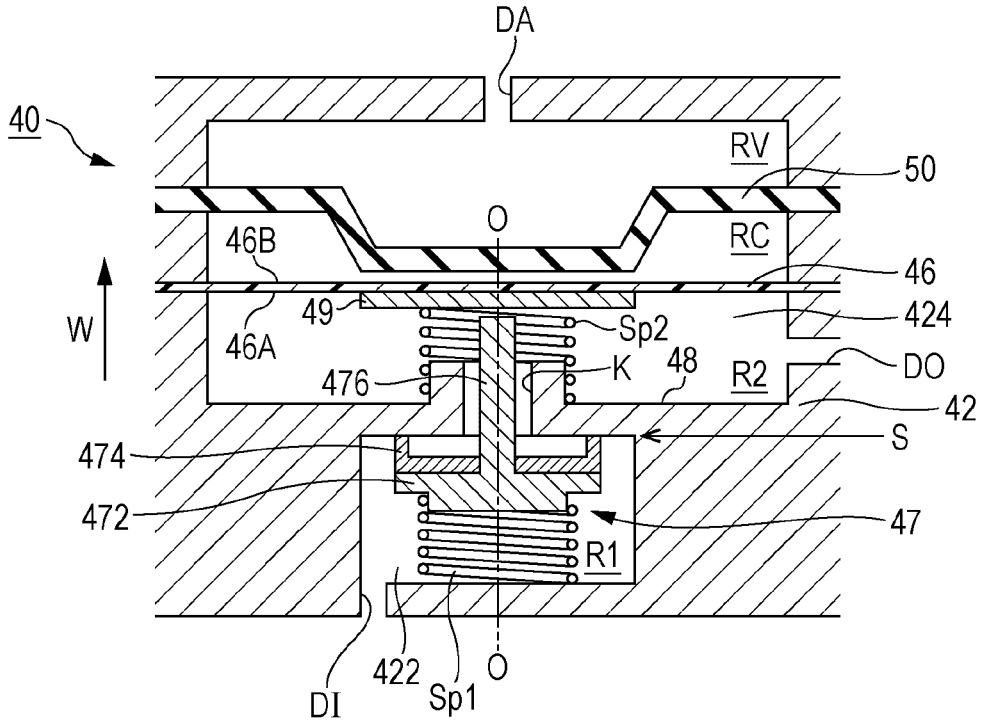
FIG. 4 is a sectional view of the structure of a valve device.

FIG. 4 is a sectional view of the structure of any one of the valve devices 40. The valve device 40 according to the present embodiment is operated due to a differential pressure between the pressure on the downstream side and the atmospheric pressure and can be forcibly operated (forced operation) due to an external force. Since the structures of the valve devices 40 are similar to or identical to one another, the valve device 40 of the supply channel S1 will be used as an example to describe the structure of the valve devices 40.

As illustrated in FIG. 4, the valve device 40 of the supply channel S1 has an upstream channel R1 and a downstream channel R2, which are included in the supply channel S1. The upstream channel R1 has an inlet DI for the ink and the downstream channel R2 has an outlet DO for the ink. The ink from the liquid container C1 flows in from the inlet DI. The introducing channel 754 of the liquid discharge unit 70 is connected to the outlet DO through the filter unit F.

The valve device 40 includes a valve body 47, a valve seat 48, a spring Sp1 and a spring Sp2. In general, the valve body 47 is moved relative to the valve seat 48 toward the positive side or the negative side in the W direction so as to be brought into contact with or separated from the valve seat 48. Thus, the upstream channel R1 is closed or opened. That is, when the valve body 47 is moved toward the positive side in the W direction so as to be brought into contact with the valve seat 48, communication between the upstream channel R1 and the downstream channel R2 is blocked, thereby the supply channel S1 assumes a closed state. In contrast, when the valve body 47 is moved toward the negative side in the W direction so as to be separated from the valve seat 48, the upstream channel R1 and the downstream channel R2 communicate with each other, thereby the supply channel S1 assumes an open state.

The valve seat 48 is part of a support 42 positioned between the upstream channel R1 and the downstream channel R2 (bottom of a recess 422 or a recess 424) and faces part of a flexible film 46 closing the downstream channel R2 (movable portion) with a gap therebetween. The valve seat 48 has a through hole K at its substantially center. The through hole K penetrates through the support 42. The through hole K has a perfect circular shape. An inner circumferential surface of the through hole K is parallel to the W direction. The upstream channel R1 positioned on the upstream side of the valve seat 48 and the downstream channel R2 positioned on the downstream side of the valve seat 48 communicate with each other through the through hole K of the valve seat 48.

The valve body 47 is disposed in the upstream channel R1. The valve body 47 includes a base portion 472, a closing portion 474, and a valve shaft 476. The base portion 472 has a circular flat plate-shape and an outer diameter of larger than an inner diameter of the through hole K. The valve shaft 476 coaxially perpendicularly projects from a surface of the base portion 472, and the annular closing portion 474 surrounding the valve shaft 476 in plan vie is disposed on the surface of the base portion 472. The valve body 47 is disposed such that the base portion 472 and the closing portion 474 are positioned in the upstream channel R1 in a state in which the valve shaft 476 is inserted into the through hole K of the valve seat 48 with an axis O directed in the W direction. A gap is formed between the inner circumferential surface of the through hole K of the valve seat 48 and an outer circumferential surface of the valve shaft 476. The spring Sp1 is provided between a surface of the support 42 facing the valve seat 48 and the base portion 472 of the valve body 47 in the upstream channel R1 and urges the valve body 47 toward the valve seat 48. The spring Sp2 is disposed between the valve seat 48 and a pressure receiving plate 49 in the downstream channel R2. The closing portion 474 of the valve body 47 is positioned between the base portion 472 and the valve seat 48 and to be brought into contact with a closing surface S of the valve seat 48 (surface on the upstream channel R1 side), thereby functioning as a seal closing the through hole K.

An atmospheric pressure chamber RC that communicates with the atmosphere is disposed adjacent to the downstream channel R2. The flexible film 46 is interposed between the downstream channel R2 and the atmospheric pressure chamber RC. The downstream channel R2 and the atmospheric pressure chamber RC are kept separated from each other by the flexible film 46. The flexible film 46 is a flexible elastic film and formed of, for example, a film, rubber, a fiber, or the like. As illustrated in FIG. 4, when the pressure in the downstream channel R2 is maintained in a specified range, the closing portion 474 of the valve body 47 is urged by the spring Sp2 so as to be pressed against the closing surface S of the valve seat 48. Thus, the communication between the upstream channel R1 and the downstream channel R2 is blocked. When the pressure in the downstream channel R2 is reduced to a specified pressure due to suction or discharge of the ink by the liquid discharge head 20, the valve body 47 is operated. That is, the closing portion 474 of the valve body 47 is separated from the closing surface S of the valve seat 48 resisting the urging forces by the spring Sp1 and the spring Sp2, thereby the upstream channel R1 and the downstream channel R2 communicate with each other.

Specifically, when a surface of the flexible film 46 defining part of the downstream channel R2 is a first surface 46A and a surface on the atmospheric pressure chamber RC side, that is, opposite to the first surface 46A is a second surface 46B, the flexible film 46 is deformed in accordance with the differential pressure between the pressure applied to the first surface 46A (atmospheric pressure) and the pressure applied to the second surface 46B (negative pressure). Due to this deformation of the flexible film 46, the valve body 47 is operated. When the negative pressure becomes a specified value relative to the atmospheric pressure, the valve body 47 is open. Thus, the upstream channel R1 and the downstream channel R2 communicate with each other, thereby the supply channel S1 is open. The example of the valve body 47 according to the present embodiment is opened/closed due to the differential pressure between the pressure applied to the first surface 46A of the flexible film 46 and the pressure applied to the second surface 46B of the flexible film 46. However, the valve body 47 may be opened/closed due to the differential pressure between the pressure in the upstream channel R1 and the pressure in the downstream channel R2.

According to the present embodiment, a pressure adjusting chamber RV is disposed adjacent to the atmospheric pressure chamber RC in the valve device 40. An elastic member 50 is interposed between the atmospheric pressure chamber RC and the pressure adjusting chamber RV. The atmospheric pressure chamber RC and the pressure adjusting chamber RV are kept separated from each other by the elastic member 50. The elastic member 50 is formed of an elastic material such as flexible rubber. The pressure adjusting chamber RV communicates with a gas channel port DA. A pump P (see FIG. 3) is connected to the gas channel port DA through a gas channel. The pump P according to the present embodiment can apply pressure to the pressure adjusting chamber RV and is typically a pneumatic pump. The pump P is driven in accordance with an instruction from the control unit 12.

As illustrated in FIG. 3, the gas channel according to the present embodiment includes a common air channel A0 and branch air channels A1 to A4. The pump P is connected to the common air channel A0. Four branch air channels A1 to A4 are branched from the common air channel A0 and separately connected to the gas channel ports DA of the respective valve devices 40. Each of the branch air channels A1 to A4 is provided with a corresponding one of solenoid valves V1 to V4. The solenoid valves V1 to V4 separately open/close the respective branch air channels A1 to A4 under the control of the control unit 12. A buffer chamber 52 is provided in the common air channel A0. The buffer chamber 52 temporarily stores the pressure of the air from the pump P.

According to the present embodiment, the pressure of the air is applied by the pump P to the pressure adjusting chamber RV, thereby bending the elastic member 50 toward the negative side in the W direction. When the elastic member 50 is bent toward the negative side in the W direction, the flexible film 46 can be deformed toward the negative side in the W direction resisting the urging forces applied by the spring Sp1 and the spring Sp2. Thus, the closing portion 474 of the valve body 47 can be forcibly separated from the closing surface S of the valve seat 48 independently of the differential pressure between the pressure on the downstream side and the atmospheric pressure.

As has been described, according to the present embodiment, when, for example, cleaning the liquid discharge head 20, the ink is pressurized and supplied to the liquid discharge head 20 through the supply channels S1 to S4. Thus, thickened ink and bubbles can be discharged from the nozzles N to the cap 322. In this case, adjustment of the supply pressure of the ink to the liquid discharge units 70 allows the flow velocity of the ink to be adjusted so as to obtain an optimum flow velocity of the ink in accordance with positions where thickening of the ink occurs and bubbles are generated in the channels of the liquid discharge head 20. For example, as the flow velocity of the ink increases, ease of removing bubbles and foreign matter trapped by the filter unit F increases. Furthermore, compared to the case where the bubbles in the filter unit F are discharged, bubbles and thickened ink near the nozzles N can be discharged from the nozzles N at a lower flow velocity. As a result, the flow velocity of the ink is reduced by such cleaning of the nozzles N. Accordingly, unnecessary consumption of the ink can be suppressed. In this case, the supply pressure of the ink to the liquid discharge units 70 can also be varied by adjusting the pressure in the liquid containers C1 to C4 by using the pressure mechanisms 142.

However, in the case where the pressure of the ink is adjusted on the upstream side of the supply channels S1 to S4 as described above, when the valve bodies 47 operable in accordance with the pressure on the downstream side are provided in the supply channels S1 to S4, the pressure adjustment is easily influenced by variation in pressure loss in the supply channels S1 to S4 due to operation of the valve bodies 47 such as responses of the valve bodies 47. Thus, variation in supply pressure of the ink to the liquid discharge units 70 is likely to increase. This increases difficulty in fine adjustment, with high accuracy, of the supply pressure of the ink to the liquid discharge units 70.

In order to address this, according to the present embodiment, the valve bodies 47 operable in accordance with the pressure on the downstream side of the valve bodies 47 are operated by an external force. Thus, the degree of opening of the valve bodies 47 from a closed state to a full-open state is adjusted and held. In this way, the supply pressure of the ink supplied to the liquid discharge units 70 is arbitrary adjusted. Accordingly, the valve bodies 47 operable in accordance with the pressure on the downstream side of the valve bodies 47 can be forcibly operated by the external force. Thus, compared to the case where the pressure is adjusted on the upstream side of the supply channels S1 to S4, it is unlikely that the pressure adjustment is influenced by variation in pressure loss. This allows fine adjustment of the pressure of the ink to be supplied to the liquid discharge units 70. Accordingly, accuracy in adjustment of the supply pressure of the ink can be improved.

Figure 5:
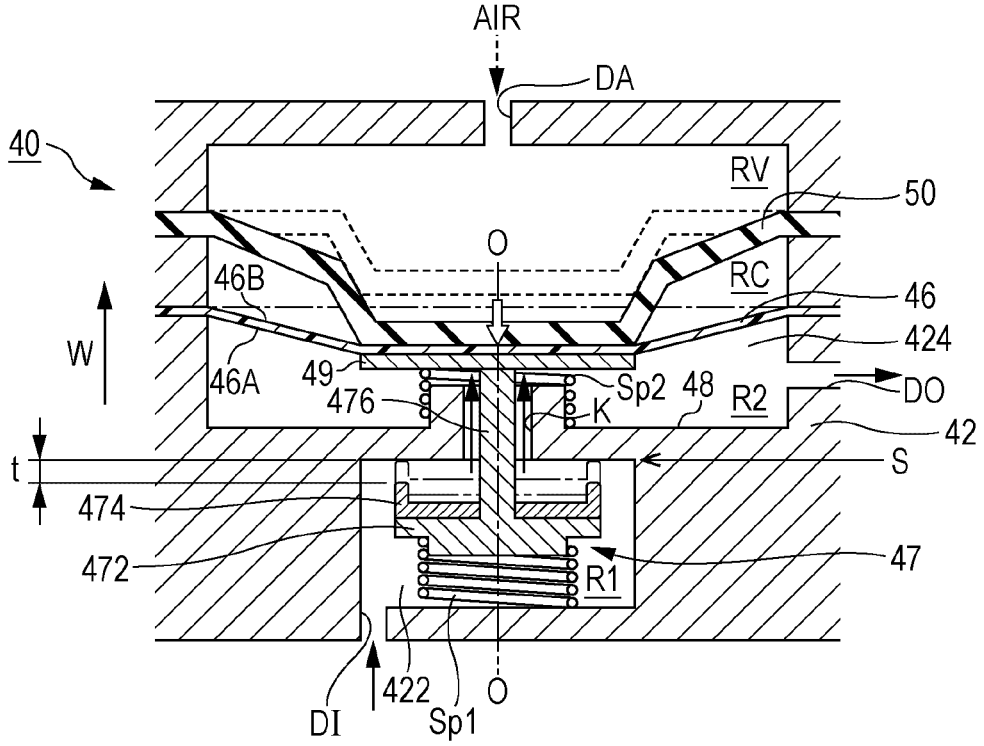
FIG. 5 illustrates operation when the valve body is in a full-open state.
Figure 6:
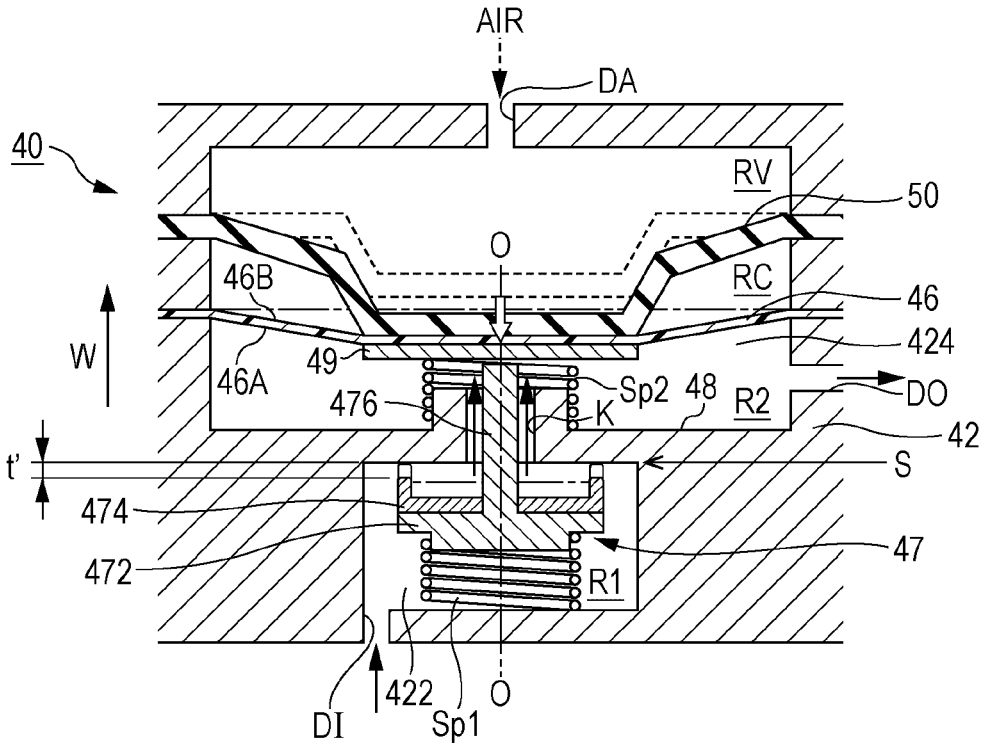
FIG. 6 illustrates operation when the valve body is in a half-open state.

FIG. 5 illustrates operation when the valve body 47 is in the full-open state. FIG. 6 illustrates operation when the valve body 47 is in a half-open state. In the valve device 40 according to the present embodiment, the pressure of the air applied by the pump P is used as the external force to adjust the pressure in the pressure adjusting chamber RV so as to bend the elastic member 50. Accordingly, the flexible film 46 is deformed independently of the negative pressure (differential pressure) in the downstream channel R2, thereby the valve body 47 can be forcibly operated. That is, the operation of the valve body 47 due to the external force herein means that the valve body 47 is forced to perform an opening operation (forced opening operation) due to the external force independently of the negative pressure (differential pressure) on the downstream channel R2. Accordingly, the pressure adjusting chamber RV and the elastic member 50 of the valve devices 40 and the pump P cooperate with one another to function as a holding mechanism that adjusts and holds the degree of opening of the valve body 47 of the valve device 40.

Specifically, as illustrated in FIGS. 5 and 6, the pressure adjusting chamber RV is pressurized by the pressure of the air. This can bend the elastic member 50, thereby the flexible film 46 is deformed toward the negative side in the W direction so as to cause the valve body 47 to perform the opening operation. In this case, the pressure in the pressure adjusting chamber RV is adjusted by using the pressure of the air applied by the pump P, thereby the degree of opening of the valve body 47 in a range between the closed state and the full-open state can be adjusted. As the pressure of the air applied by the pump P increases, the magnitude of the bending of the elastic member 50 toward the negative side in the W direction increases. Accordingly, the magnitude of the deformation of the flexible film 46 increases, and the amount of movement of the valve body 47 toward the negative side in the W direction increases. In contrast, as the pressure of the air applied by the pump P reduces, the magnitude of the bending of the elastic member 50 toward the negative side in the W direction reduces. Accordingly, the magnitude of the deformation of the flexible film 46 reduces, and the amount of movement of the valve body 47 toward the negative side in the W direction reduces. The amount of movement of the valve body 47 toward the negative side in the W direction corresponds to the degree of opening of the valve body 47.

For example, the pressure of the air applied by the pump P in FIG. 6 is smaller than the pressure of the air applied by the pump P in FIG. 5. Thus, the degree of opening (the amount of movement toward the negative side in the W direction) t' of the valve body 47 in FIG. 6 is smaller than the degree of opening (the amount of movement toward the negative side in the W direction) t of the valve body 47 in FIG. 5. Accordingly, as the degree of opening of the valve body 47 reduces, the pressure loss of the ink increases. This reduces the pressure of the ink supplied to the liquid discharge unit 70. Accordingly, the supply pressure of the ink to the liquid discharge unit 70 is smaller in FIG. 6 than that in FIG. 5.

Figure 7:
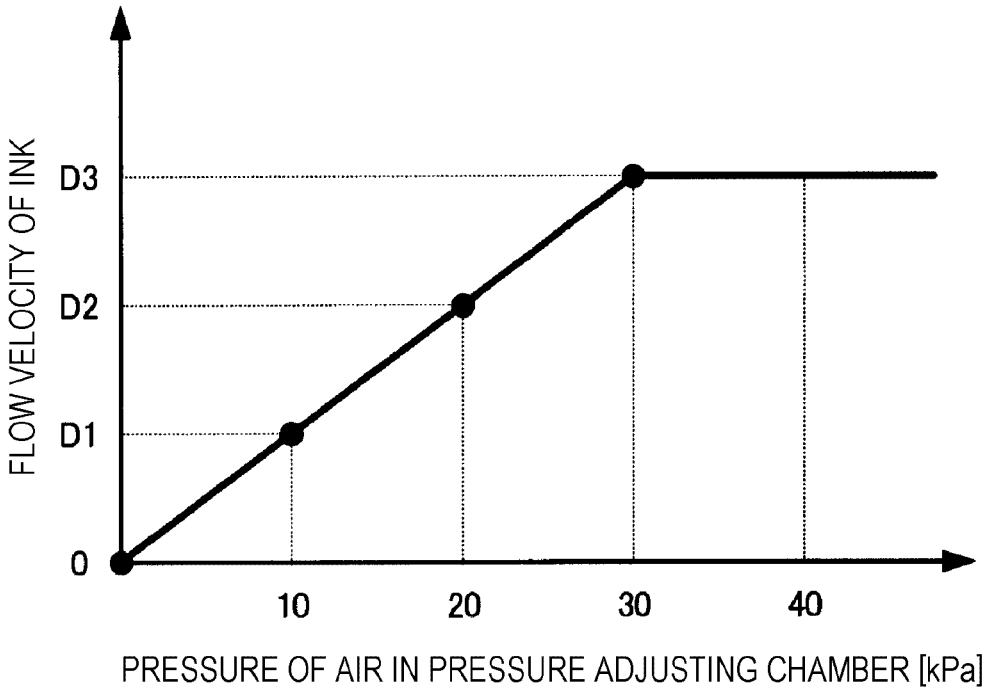
FIG. 7 is a graph illustrating the relationship between the pressure of air in a pressure adjusting chamber and the flow velocity of the ink.

FIG. 7 is a graph illustrating the relationship between the pressure of the air in the pressure adjusting chamber RV and the flow velocity of the ink. in FIG. 7, the horizontal axis represents the pressure of the air in the pressure adjusting chamber RV, and the vertical axis represents the flow velocity of the ink. From the graph illustrated in FIG. 7, it can be understood that the pressure of the pump P is substantially proportional to the flow velocity of the ink. That is, as the pressure of the pump P increases, the degree of opening of the valve body 47 increases. This increase in the degree of opening of the valve body 47 increases the supply pressure of the ink to the liquid discharge unit 70, thereby increasing the flow velocity of the ink.

Thus, according to the first embodiment, when cleaning the liquid discharge head 20, the degree of opening of each of the valve bodies 47 is adjusted in accordance with the positions where thickening of the ink occurs and bubbles are generated in the flow channels in the liquid discharge head 20 so as to vary the flow velocity of the ink.

Specifically, in the example according to the present embodiment, as illustrated in FIG. 7, three levels of the degree of opening of the valve body 47 in a range between the closed state and the full-open state are provided so as to classify the flow velocity of the ink into three levels of the velocity D1, D2, and D3. In FIG. 7, when the degree of opening of the valve body 47 is in the full-open state, the supply pressure of the ink to the liquid discharge unit 70 is 30 kPa. In this case, when the pressure of the air in the pressure adjusting chamber RV is controlled at three levels of the pressure 10 kPa, 20 kPa, and 30 kPa, the ink can be supplied to the liquid discharge unit 70 at the flow velocities D1, D2, and D3, respectively. At the flow velocities D1, D2, and D3, the supply pressure of the ink to the liquid discharge unit 70 is 10 kPa, 20 kPa, and 30 kPa, respectively.

Thus, the target values of the supply pressures of the ink to the liquid discharge unit 70 are 10 kPa, 20 kPa, and 30 kPa. In the present embodiment, the example in which three levels of the degree of opening of the valve body 47 are provided is described. However, this is not limiting. Two levels or four or more levels of the degree of opening of the valve body 47 may be provided. Furthermore, the degree of opening of the valve body 47 may be linearly adjusted. It is noted that, when the degree of opening of the valve body 47 is set to a plurality of levels or linearly set, the degree of opening of the valve body 47 is held in an arbitrary state. The degree of opening while the valve body 47 is being moved is not considered as a degree of opening.

At a supply pressure of the ink of 10 kPa (flow velocity of D1), bubbles and thickened ink near the nozzles N can be discharged. Accordingly, there is a high probability that cleaning of the nozzles N can be sufficiently performed instead of setting the supply pressure of the ink to 20 kPa or 30 kPa. Thus, cleaning the nozzles N at a supply pressure of the ink of 10 kPa can suppress unnecessary consumption of the ink.

At a supply pressure of the ink of 20 kPa (flow velocity of D2), bubbles and foreign matter accumulated in the common liquid chamber SR can be discharged. Accordingly, for cleaning of the common liquid chamber SR, it is sufficient that the supply pressure of the ink be set to 20 kPa instead of setting to 30 kPa. Thus, cleaning the common liquid chamber SR at a supply pressure of the ink of 20 kPa can suppress unnecessary consumption of the ink.

At a supply pressure of the ink of 30 kPa (flow velocity of D3), bubbles and foreign matter trapped by the filter units F can be easily discharged. Accordingly, when the supply pressure of the ink to 30 kPa for cleaning the filter units F, effects of cleaning the filter units F can be improved.

The supply pressure of the ink of 10 kPa may be insufficient for cleaning the nozzles N. In this case, when the supply pressure of the ink is set to 20 kPa or 30 kPa for the cleaning, bubbles and thickened ink that cannot be sufficiently removed with the supply pressure of the ink of 10 kPa or 20 kPa can be removed. Furthermore, the supply pressure of the ink of 20 kPa may be insufficient for cleaning the common liquid chamber SR. In this case, when the supply pressure of the ink is set to 30 kPa for the cleaning, bubbles and thickened ink that cannot be sufficiently removed with the supply pressure of the ink of 20 kPa can be removed.

According to the present embodiment, when the target values of the supply pressures of the ink is 10 kPa, 20 kPa, or 30 kPa and the pressure of the pump P is varied in accordance with the target values, the degree of opening is adjusted on a valve-body-47 by valve-body-47 basis. This can suppress an excessive increase of the pressure of the pump P. Thus, a period of time taken for the supply pressure of the ink to become the target value can be reduced, and accordingly, the burden on the pump P can be reduced.

Specifically, as illustrated in case 1 of FIG. 8, when the pump P is driven with the pressure set to 10 kPa and the solenoid valves V1 to V4 are fully opened, the degree of opening of the valve bodies 47 is ⅓ of the full-open state, and the supply pressure of the ink to the liquid discharge units 70 is 10 kPa (flow velocity of D1). Furthermore, as illustrated in case 2 of FIG. 8, when the pump P is driven with the pressure set to 20 kPa and the solenoid valves V1 to V4 are fully opened, the degree of opening of the valve bodies 47 is ⅔ of the full-open state, and the supply pressure of the ink to the liquid discharge units 70 is 20 kPa (flow velocity of D2). Furthermore, as illustrated in case 3 of FIG. 8, when the pump P is driven with the pressure set to 30 kPa and the solenoid valves V1 to V4 are fully opened, the degrees of opening of the valve bodies 47 is 3/3 (1) of the full-open state, and the supply pressure of the ink to the liquid discharge units 70 is 30 kPa (flow velocity of D3).

A period of time taken for the pressure of the air applied by the pump P to increase to the target value of the supply pressure of the ink reduces as the supply pressure of the ink reduces. In the specific example illustrated in FIG. 8, the period of time taken for the supply pressure of the ink to become the target value reduces in the sequence of the supply pressure of the ink from 30 kPa, 20 kPa to 10 kPa. Accordingly, in cleaning the nozzles N, for example, in the cleaning of the nozzles N as described above, when the target value of the supply pressure of the ink is 10 kPa being smaller than 20 kPa, a period of time of cleaning can reduce, and accordingly, the burden on the pump P can be reduced.

As illustrated in FIG. 3, the common air channel A0 is connected to the pump P according to the present embodiment, the branch air channels A1 to A4 that correspond to the respective valve bodies 47 are branched from the common air channel A0, and the branch air channels A1 to A4 are provided with the respective solenoid valves V1 to V4. Thus, the pressure applied by the pump P is adjusted for the branch air channels A1 to A4 by using the respective solenoid valves V1 to V4. This allows the degrees of opening of the valve bodies 47 to be separately adjusted. Accordingly, even when a low-performance pump with low pressure accuracy is used as the pump P according to the present embodiment, the degrees of opening of the valve bodies 47 can be adjusted. This can improve accuracy in adjustment of the supply pressure of the ink.

When the pressure of the pump P is set to, for example, 20 kPa, this 20 kPa is effective with the degrees of opening of the valve bodies 47 set in the full-open state. In this case, as illustrated in case 4 of FIG. 9, when only the degree of opening of the solenoid valve V1 is ½, and the degrees of opening of the other solenoid valves V2 to V4 are 0 (closed state), only the degree of opening of the valve body 47 of the supply channel S1 can be ½. Thus, only the supply pressure of the ink toward the liquid discharge unit 70 from the supply channel S1 can be 10 kPa. When the degree of opening of any of the valve bodies 47 is adjusted as described above, the supply pressure of the ink to the corresponding liquid discharge unit 70 from the corresponding supply channel (S1, S2, S3, or S4) can be adjusted.

Furthermore, in case 5 of FIG. 9, the degree of opening of the solenoid valve V1 is ½, and the degrees of opening of the other solenoid valves V2 to V4 are 1 (full-open state). Thus, the degree of opening of the valve body 47 of the supply channel S1 can be ½ of the full-open state, and the degrees of opening of the valve bodies 47 for the other supply channels S2 to S4 can be the full-open state. Accordingly, the supply pressure of the ink from the supply channel S1 can be 10 kPa, and the supply pressures of the ink from the other supply channels S2 to S4 can be 20 kPa. As described above, since the degrees of opening of the valve bodies 47 can be separately varied for the supply channels S1 to S4, the supply pressures of the ink to the liquid discharge units 70 can be separately varied for the supply channels S1 to S4.

In addition, when the pressure of the pump P is set to 30 kPa, this 30 kPa is effective with the degrees of opening of the valve bodies 47 in the full-open state. In this case, as illustrated in case 6 of FIG. 9, when only the degree of opening of the solenoid valve V1 is ⅓, and the degrees of opening of the other solenoid valves V2 to V4 are 0 (closed state), only the degree of opening of the valve body 47 of the supply channel S1 can be ⅓ of the full-open state. Thus, only the supply pressure of the ink toward the liquid discharge unit 70 from the supply channel S1 can be 10 kPa. Even when the pressure of the pump P is set to, as in case 6 of FIG. 9, 30 kPa being higher than 20 kPa in case 4, the supply pressure of the ink from the supply channel S1 to the liquid discharge unit 70 can be 10 kPa, the same pressure as that of case 4, with the degree of opening of the solenoid valve V1 being ⅓.

Furthermore, in case 7 of FIG. 9, the degree of opening of the solenoid valve V1 is ⅓, the degree of opening of the solenoid valve V2 is ⅔, and the degrees of opening of the solenoid valves V3 and V4 are 1 (full-open state). Thus, the degree of opening of the valve body 47 of the supply channel S1 can be ⅓ of the full-open state, the degree of opening of the valve body 47 of the supply channel S2 can be ⅔ of the full-open state, and the degrees of opening of the valve bodies 47 of the supply channels S3 and S4 can be 1 (full-open state). Accordingly, the supply pressure of the ink from the supply channel S1 can be 10 kPa, the supply pressure of the ink from the supply channel S2 can be 20 kPa, and the supply pressures of the ink from the supply channels S3 and S4 can be 30 kPa. When the pressure of the pump P is set to 30 kPa and the degrees of opening of the solenoid valves V1 to V4 are adjusted, the pressure of the pump P applied to the respective pressure adjusting chambers RV can be varied from 10 kPa to 30 kPa.

Figure 10:
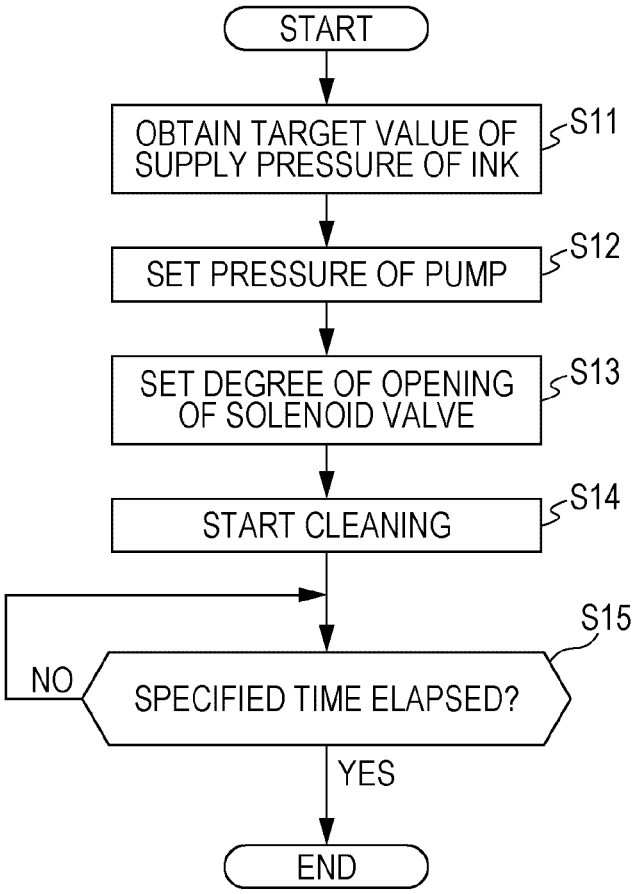
FIG. 10 is a flowchart illustrating a method of controlling during cleaning according to the first embodiment.

Next, a method of controlling the liquid discharge device 10 when cleaning the liquid discharge head 20 according to the first embodiment is described. Cleaning of the liquid discharge head 20 may be periodically performed or performed in accordance with an instruction by the user from an operating panel (not illustrated). FIG. 10 is a flowchart illustrating the method of controlling when cleaning the liquid discharge head 20 according to the first embodiment. Referring to FIG. 10, first control is control performed by the controller 122 so as to cause the pressure mechanisms 142 to apply pressure to the ink in the liquid containers C1 to C4 so as to supply the ink to the supply channels S1 to S4, and second control is control performed by the controller 122 so as to cause the valve bodies 47 operable in accordance with the pressures on the downstream side thereof to be operated by the external force applied by the pump P so as to arbitrarily adjust and hold the degrees of opening of the valve bodies 47 in a range between the closed state and the full-open state. Here, as illustrated in the specific example of FIG. 7, the target value of the supply pressure of the ink is classified into three levels, that is, 10 kPa, 20 kPa, and 30 kPa.

As illustrated in FIG. 10, first, in step S11, the controller 122 obtains the target values of the supply pressures of the ink for the supply channels S1 to S4. The target value of the supply pressure of the ink is selected in accordance with the position to be cleaned. For cleaning of the nozzles N, the target value of the supply pressure of the ink is 10 kPa, for cleaning of the common liquid chamber SR, the target value of the supply pressure of the ink is 20 kPa, and for cleaning of the filter units F, the target value of the supply pressure of the ink is 30 kPa. A position selected by the user in the operating panel (not illustrated) may be obtained as the position to be cleaned. Alternatively, the position to be cleaned detected by a detector (not illustrated) may be obtained.

Next, the controller 122 sets the pressure of the pump P in step S12. The pressure of the pump P is selected from among 10 kPa, 20 kPa, and 30 kPa as illustrated in FIG. 7. The controller 122 sets the pressure of the pump P in accordance with the target values of the supply pressures of the ink for the supply channels S1 to S4 obtained in step S11. Specifically, the controller 122 sets the pump pressure as follows: when the maximum value of the target values of the supply pressures of the ink for the supply channels S1 to S4 is 30 kPa, the pressure of the pump P is set to 30 kPa; when the maximum value of the target values of the supply pressures of the ink for the supply channels S1 to S4 is 20 kPa, the pressure of the pump P is set to 20 kPa; and when the maximum value of the target values of the supply pressures of the ink for the supply channels S1 to S4 is 10 kPa, the pressure of the pump P is set to 10 kPa. The pressure of the pump P is varied in accordance with the target values of the supply pressures of the ink as described above. This can suppress an excessive increase of the pressure of the pump P. Thus, a period of time taken for the supply pressure of the ink to become the target value can be reduced, and accordingly, the burden on the pump P can be reduced.

Next, in step S13, the controller 122 sets the degrees of opening of the solenoid valves V1 to V4. The degrees of opening of the solenoid valves V1 to V4 are set in accordance with the target values of the supply pressures of the ink for the supply channels S1 to S4 obtained in step S11 and the pressure of the pump P obtained in step S12. Specifically, as illustrated in, for example, case 7 of FIG. 9, when the pressure of the pump P is 30 kPa and the target values of the supply pressures of the ink for the supply channels S1 to S4 are respectively 10 kPa, 20 kPa, 30 kPa, and 30 kPa, the controller 122 sets the degrees of opening of the solenoid valves V1 to V4 to ⅓, ⅔, 1 (full-open state), and (full-open state), respectively. When the pressure applied by the pump P is adjusted separately for the branch air channels A1 to A4 by using the respective solenoid valves V1 to V4 as described above, the degrees of opening of the valve bodies 47 can be separately adjusted. Accordingly, even when a low-performance pump with low pressure accuracy is used as the pump P according to the present embodiment, the degrees of opening of the valve bodies 47 can be adjusted. This can improve accuracy in adjustment of the supply pressure of the ink.

Next, the controller 122 performs in step S14 the first control and the second control to perform the cleaning. Specifically, the cap 322 is caused to be brought into contact with the discharge surface of the liquid discharge head 20 so as to close the nozzles N with the carriage 18 having been moved to the non-printing region H. Then, when the first control and the second control are performed, thickened ink and bubbles are discharged from the nozzles N to the cap 322. The first control causes the pressure mechanisms 142 to apply pressure to the ink in the liquid containers C1 to C4 so as to supply the ink in the supply channels S1 to S4. The second control causes the pump P to drive at the pressure of the pump P set in step S12 so as to control the solenoid valves V1 to V4 with the degrees of opening set in step S13. Thus, the valve bodies 47 operable in accordance with the pressure on the downstream side thereof are operated by the pressures of the pump P adjusted by the degrees of opening of the solenoid valves V1 to V4, thereby arbitrarily adjusting and holding the degrees of opening of the valve bodies 47 in a range between the closed state and the full-open state.

Next, the controller 122 determines in step S15 whether a specified period of time has elapsed. When it is determined in step S15 that the specified period of time has not elapsed, the controller 122 performs cleaning until the specified time elapses. When it is determined in step S15 that the specified period of time has elapsed, the controller 122 causes the pump P to stop and the cap 322 to be separated from the discharge surface of the liquid discharge head 20. Thus, the cleaning ends.

As has been described, according to the present embodiment, the first control and the second control are performed for each of the supply channels S1 to S4. Thus, the supply pressure of the ink can be finely adjusted for each of the supply channels S1 to S4 with high accuracy. Furthermore, since the second control for the valve bodies 47 is simultaneously performed, compared to the case where the second control is serially performed on the different valve bodies 47 at different times, a period of time taken to perform the second control on a plurality of the valve bodies 47 can be reduced.

As illustrated in FIG. 3, the common air channel A0 according to the present embodiment is provided with the buffer chamber 52. This allows the degrees of opening of the valve bodies 47 to be adjusted by the pressure of the air stored in the buffer chamber 52. Specifically, for example, the above-described second control may include a step in which the solenoid valves V1 to V4 are closed and the pump P is driven so as to store the pressure of the air in the buffer chamber 52, and a step in which the solenoid valves V1 to V4 are opened so as to adjust the degrees of opening of the valve bodies 47 by the pressure of the air stored in the buffer chamber 52. This allows the degrees of opening of the valve bodies 47 to be adjusted by the pressure of the air stored in the buffer chamber 52. Accordingly, even when a low-performance pump of low pressure is used as the pump P according to the present embodiment, the degrees of opening of the valve bodies 47 can be adjusted. This can improve accuracy in adjustment of the supply pressure of the ink.

Furthermore, in each of the valve devices 40 according to the present embodiment, the flexible film 46 can be forcibly deformed by the external force applied from the second surface 46B side of the flexible film 46 by the pump P. Thus, the valve body 47 can be operated independently of the differential pressure between the pressure on the first surface 46A side and the pressure on the second surface 46B side. Accordingly, the pressure of the ink can be finely adjusted without being influenced by the differential pressure. This can improve accuracy in adjustment of the supply pressure of the ink.

Second Embodiment

A second embodiment of the invention is described. In the following exemplary forms, elements the effects and the functions of which are the same as or similar to those of the first embodiment are denoted by like reference signs used in the description of the first embodiment, and detailed description thereof is appropriately omitted. According to the first embodiment, the holding mechanism that adjusts and holds the degree of opening of the valve body 47 of each of the valve devices 40 is exemplified by the case in which the pressure of the pump P that exemplifies the external force forcibly operating the valve body 47 is utilized. In an example according to the second embodiment, an eccentric cam 54 that exemplifies the external force forcibly operating the valve body 47 is utilized as the external force.

Figure 11:
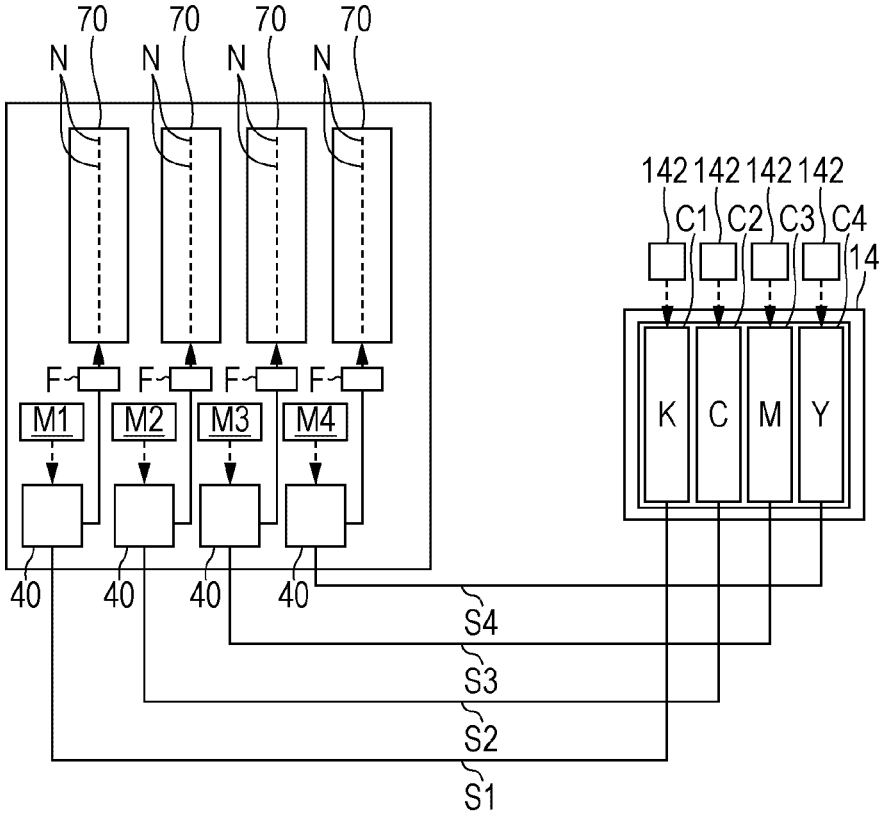
FIG. 11 illustrates the structure of the supply channels for the ink according to a second embodiment.
Figure 12:
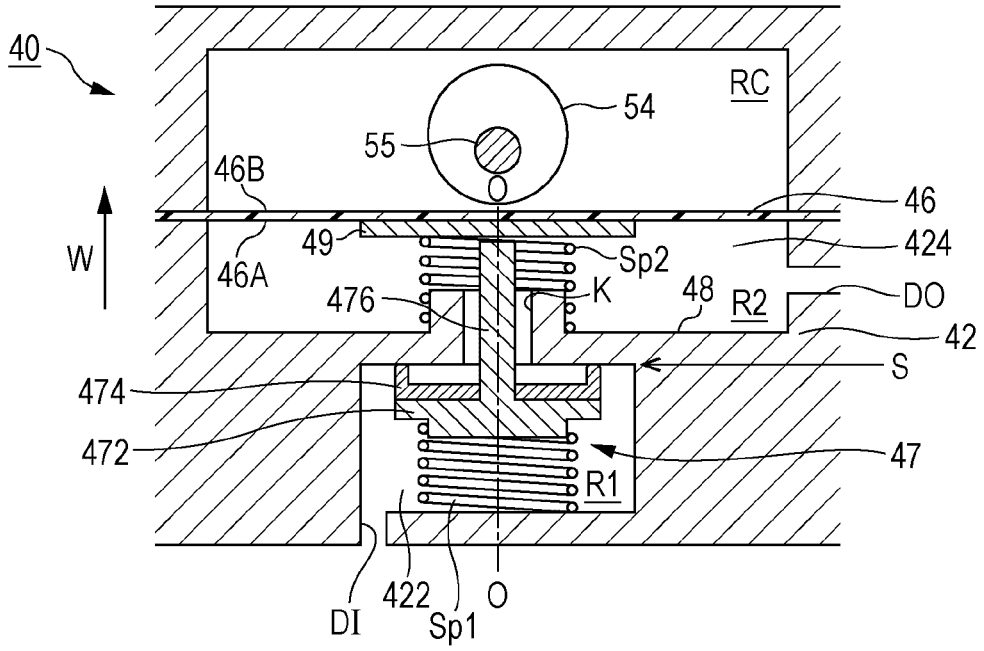
FIG. 12 is a sectional view of the structure of a valve device according to the second embodiment.

FIG. 11 illustrates the structure of the supply channels S1 to S4 for the ink according to the second embodiment, corresponding to FIG. 3. FIG. 12 is a sectional view of the structure of any one of the valve devices 40 according to the second embodiment, corresponding to FIG. 4. The valve device 40 illustrated in FIG. 12 is provided with the eccentric cam 54 disposed in the atmospheric pressure chamber RC. The eccentric cam 54 faces the pressure receiving plate 49. The eccentric cam 54 is eccentrically attached to a drive rod 55 that spans in a direction perpendicular to the W direction and that is rotated. The eccentric cam 54 of each of the valve devices 40 is driven by a corresponding one of motors Ml to M4 illustrated in FIG. 11. Rotation of the motors Ml to M4 is controlled by the controller 122.

The eccentric cam 54 is rotated by the drive rod 55 so as to press the pressure receiving plate 49 toward the upstream channel R1 side. Due to this operation, the flexible film 46 is also displaced in the same direction, thereby the valve body 47 is pressed down toward the negative side in the W direction and in the open state (a state indicated by solid lines in FIG. 13). In this way, the valve body 47 can be forcibly operated independently of the pressure on the downstream side of the valve body 47.

Thus, also with the eccentric cam 54 according to the present embodiment, the valve body 47 operable in accordance with the pressure on the downstream side thereof is operated by the external force, thereby the degree of opening of the valve body 47 in a range between the closed state and the full-open state can be arbitrarily adjusted and held. In this way, the supply pressure of the ink supplied to the liquid discharge unit 70 is arbitrary adjusted.

Figure 13:
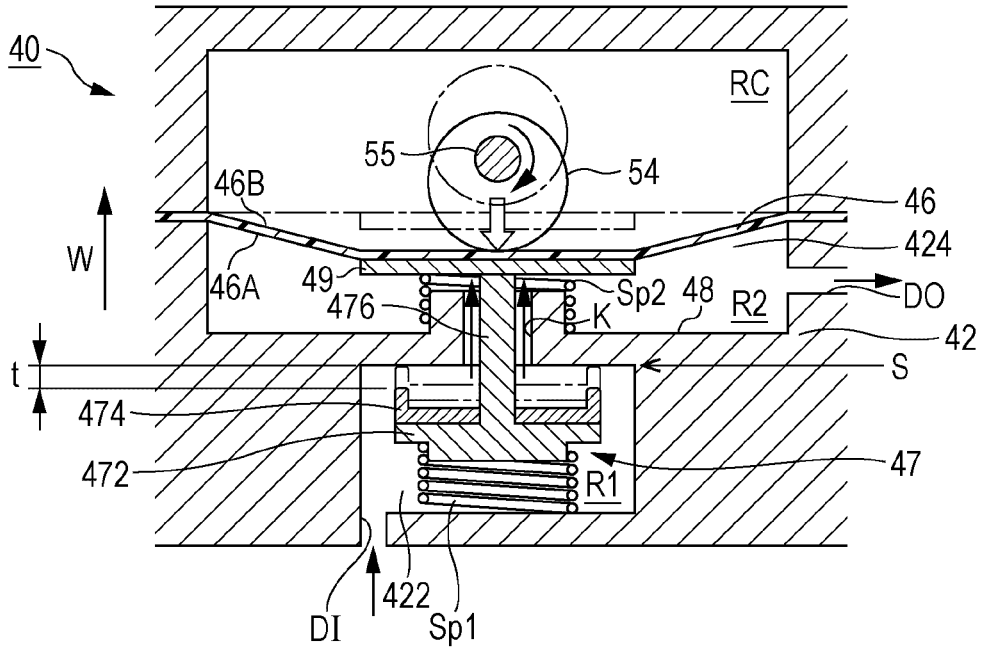
FIG. 13 illustrates operation when a valve body according to the second embodiment is in the full-open state.
Figure 14:
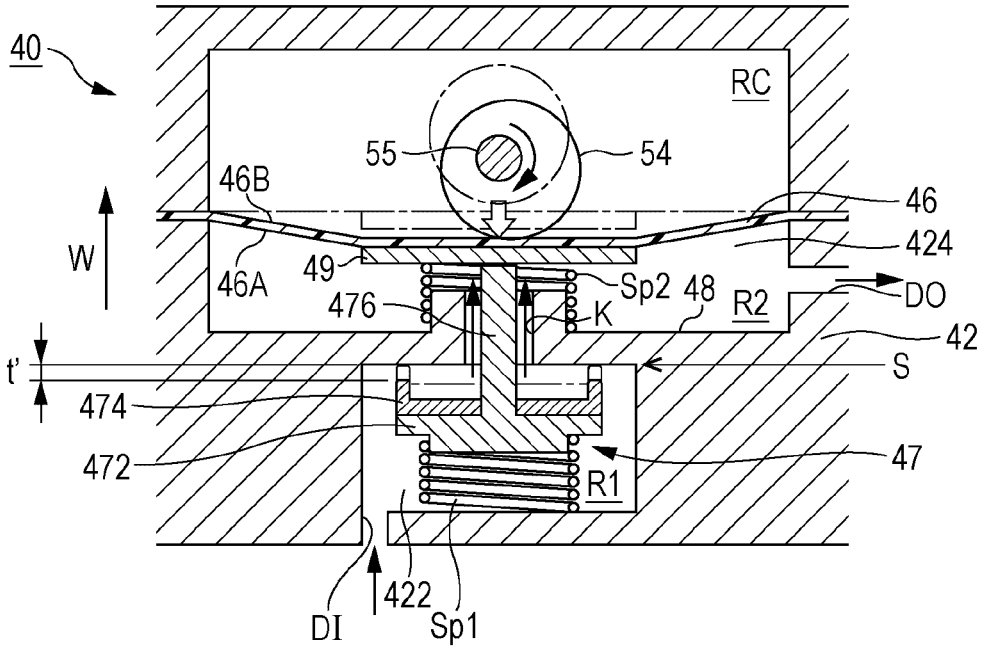
FIG. 14 illustrates operation when the valve body according to the second embodiment is in the half-open state.

FIG. 13 illustrates operation when the valve body 47 according to the second embodiment is in the full-open state. FIG. 14 illustrates operation when the valve body 47 according to the second embodiment is in the half-open state. In each of the valve devices 40 according to the second embodiment, the eccentric cam 54 rotated by a corresponding one of the motors Ml to M4 is used as the external force so as to deform the flexible film 46, so that the valve body 47 can be forcibly operated. Accordingly, each of the eccentric cams 54 and a corresponding one of the motors Ml to M4 function as the holding mechanism that adjusts and holds the degree of opening of the valve body 47 of the valve device 40.

Specifically, as illustrated in FIGS. 13 and 14, when the eccentric cam 54 is rotated, the flexible film 46 is deformed toward the negative side in the W direction so as to allow the valve body 47 to perform the opening operation. In this case, the degree of opening of the valve body 47 can be adjusted in a range between the closed state and the full-open state by adjusting the rotational angle of the eccentric cam 54. Since the amount of displacement of the flexible film 46 can be varied in accordance with the rotational angle of the eccentric cam 54, the amount of movement of the valve body 47 toward the negative side in the W direction, that is, the degree of opening of the valve body 47 can be varied.

For example, the amount of movement of the valve body 47 toward the negative side in the W direction due to the rotational angle of the eccentric cam 54 is smaller in FIG. 14 than that in FIG. 13. Thus, the degree of opening (the amount of movement toward the negative side in the W direction) t' of the valve body 47 in FIG. 14 is smaller than the degree of opening (the amount of movement toward the negative side in the W direction) t of the valve body 47 in FIG. 13. As the degree of opening of the valve body 47 reduces, the pressure loss of the ink increases, and accordingly, the pressure of the ink supplied to the liquid discharge unit 70 reduces. Accordingly, the supply pressure of the ink to the liquid discharge unit 70 is smaller in FIG. 14 than that in FIG. 13.

Figure 15:
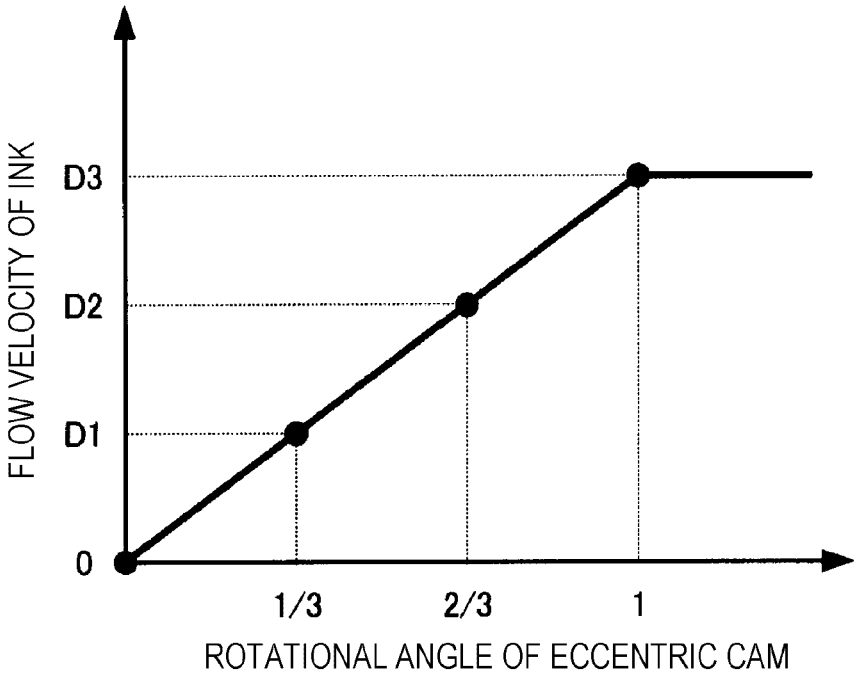
FIG. 15 is a graph illustrating the relationship between the rotational angle of an eccentric cam and the flow velocity of the ink.

FIG. 15 is a graph illustrating the relationship between the rotational angle of the eccentric cam 54 and the flow velocity of the ink, corresponding to FIG. 7. In FIG. 15, the horizontal axis represents the rotational angle of the eccentric cam 54, and the vertical axis represents the flow velocity of the ink. In FIG. 15, the rotational angle of the eccentric cam 54 is 1 when the degree of opening of the valve body 47 is in the full-open state. Accordingly, when the rotational angle of the eccentric cam 54 is ⅓, the degree of opening of the valve body 47 is ⅓ of the full-open state, and when the rotational angle of the eccentric cam 54 is ⅔, the degree of opening of the valve body 47 is ⅔ of the full-open state. From the graph illustrated in FIG. 15, it can be understood that the rotational angle of the eccentric cam 54 is substantially proportional to the flow velocity of the ink. That is, the degree of opening of the valve body 47 can be varied in accordance with the rotational angle of the eccentric cam 54. Thus, the supply pressure of the ink to the liquid discharge unit 70 is varied, and accordingly, the flow velocity of the ink can be varied.

According to the second embodiment as described above, as is the case with the first embodiment, when cleaning the liquid discharge head 20, the degree of opening of each of the valve bodies 47 is adjusted in accordance with the positions where thickening of the ink occurs and bubbles are generated in the flow channels in the liquid discharge head 20 so as to allow the flow velocity of the ink to be varied. Specifically, also in the example according to the second embodiment, as is the case with the first embodiment, three levels of the degree of opening of the valve body 47 in a range between the closed state and the full-open state are provided so as to classify the flow velocity of the ink into three levels of the velocity D1, D2, and D3. In this way, the target values of the supply pressures of the ink to the liquid discharge unit 70 can be 10 kPa, 20 kPa, and 30 kPa.

Also according to the second embodiment, when the target value of the supply pressure of the ink is set to 10 kPa, 20 kPa, or 30 kPa and the rotational angle of the eccentric cam 54 is varied in accordance with the target value, the degree of opening can be adjusted on a valve-body-47 by valve-body-47 basis. Specifically, as illustrated in case 1 of FIG. 16, when only the rotational angle of the eccentric cam 54 of the valve device 40 of the supply channel S1 is ⅓, and the rotational angles of the eccentric cams 54 of the other valve devices 40 are 0, only the degree of opening of the valve body 47 of the supply channel S1 can be ⅓. Thus, as in case 4 and case 7 of FIG. 9, only the supply pressure of the ink toward the liquid discharge unit 70 from the supply channel S1 can be 10 kPa also in case 1 of FIG. 16. When the degree of opening of any of the valve bodies 47 is adjusted as described above, the supply pressure of the ink to the corresponding liquid discharge unit 70 from the corresponding supply channel (S1, S2, S3, or S4) can be adjusted.

Furthermore, in case 2 of FIG. 16, the rotational angle of the eccentric cam 54 is ⅓ for the valve device 40 of the supply channel S1, the rotational angle of the eccentric cam 54 is ⅔ for the valve device 40 of the supply channel S2, and the rotational angles of the eccentric cams 54 for the valve devices 40 of the supply channels S3 and S4 are (full-open state). Thus, also in case 2 of FIG. 16, as in case 7 of FIG. 9, the degree of opening of the valve body 47 of the supply channel S1 can be ⅓ of the full-open state, the degree of opening of the valve body 47 of the supply channel S2 can be ⅔ of the full-open state, and the degrees of opening of the valve bodies 47 of the supply channels S3 and S4 can be 1 (full-open state). Accordingly, the supply pressure of the ink from the supply channel S1 can be 10 kPa, the supply pressure of the ink from the supply channel S2 can be 20 kPa, and the supply pressures of the ink from the supply channels S3 and S4 can be 30 kPa.

Figure 17:
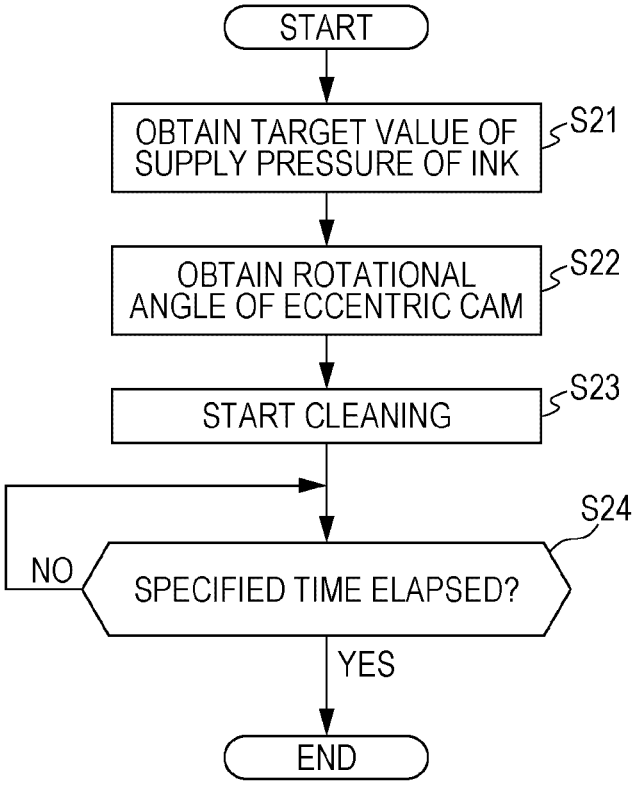
FIG. 17 is a flowchart illustrating a method of controlling during cleaning according to the second embodiment.

Next, a method of controlling the liquid discharge device 10 when cleaning the liquid discharge head 20 according to the second embodiment is described. Also according to the second embodiment, cleaning of the liquid discharge head 20 may be periodically performed or performed in accordance with an instruction by the user from an operating panel (not illustrated). FIG. 17 is a flowchart illustrating the method of controlling when cleaning the liquid discharge head 20 according to the second embodiment. Referring to FIG. 17, first control is control performed by the controller 122 so as to cause the pressure mechanisms 142 to apply pressure to the ink in the liquid containers C1 to C4 so as to supply the ink to the supply channels S1 to S4, and second control is control performed by the controller 122 so as to cause the valve bodies 47 operable in accordance with the pressures on the downstream side thereof to be operated by the external force applied by the eccentric cams 54 so as to arbitrarily adjust and hold the degrees of opening of the valve bodies 47 in a range between the closed state and the full-open state. Here, as illustrated in the specific example of FIG. 15, the target value of the supply pressure of the ink is at three levels, that is, 10 kPa, 20 kPa, and 30 kPa.

As illustrated in FIG. 17, first, in step S21, the controller 122 obtains the target values of the supply pressures of the ink for the supply channels S1 to S4. Since step S21 is similar to step S11 illustrated in FIG. 10, detailed description of step S21 is omitted. Next, in step S22, the controller 122 sets the rotational angles of the eccentric cams 54. The rotational angle of each of the eccentric cams 54 is selected from among ⅓, ⅔, and 1 as illustrated in FIG. 15. The controller 122 sets the rotational angles of the eccentric cams 54 in accordance with the target values of the supply pressures of the ink for the supply channels S1 to S4 obtained in step S21. Specifically, the controller 122 sets the rotational angles of the eccentric cams 54 as follows: when the target value is 30 kPa out of the target values of the supply pressures of the ink for the supply channels S1 to S4, the rotational angle of the eccentric cam 54 is set to 1; when the target value is 20 kPa out of the target values of the supply pressures of the ink for the supply channels S1 to S4, the rotational angle of the eccentric cam 54 is set to ⅔; and when the target value is 10 kPa out of the target values of the supply pressures of the ink for the supply channels S1 to S4, the rotational angle of the eccentric cam 54 is set to ⅓.

Next, the controller 122 performs in step S23 the first control and the second control to perform the cleaning. Specifically, the cap 322 is caused to be brought into contact with the discharge surface of the liquid discharge head 20 so as to close the nozzles N with the carriage 18 having been moved to the non-printing region H. Then, when the first control and the second control are performed, thickened ink and bubbles are discharged from the nozzles N to the cap 322. The first control causes the pressure mechanisms 142 to apply pressure to the ink in the liquid containers C1 to C4 so as to supply the ink to the supply channels S1 to S4. The second control causes the eccentric cams 54 to be rotated through the rotational angles set in step S22 and holds the rotational angle. Thus, the eccentric cams 54 arbitrarily adjust and hold the degrees of opening of the valve bodies 47 operable in accordance with the pressures on the downstream side thereof in a range between the closed state and the full-open state of the valve bodies 47.

Next, the controller 122 determines in step S24 whether a specified period of time has elapsed. When it is determined in step S24 that the specified period of time has not elapsed, the controller 122 performs cleaning until the specified time elapses. When it is determined in step S24 that the specified period of time has elapsed, the controller 122 causes the eccentric cams 54 to be returned to their original positions (closed state) and the cap 322 to be separated from the discharge surface of the liquid discharge head 20. Thus, the cleaning ends.

According to the second embodiment having been described, the degrees of opening of the valve bodies 47 can be adjusted only by varying the rotational angles of the eccentric cams 54 in accordance with the target values of the supply pressures of the ink. Thus, with the eccentric cams 54, the degrees of opening of the valve bodies 47 can be arbitrarily adjusted and held by holding the rotational angles at arbitrary positions. This increases ease of adjusting the degrees of opening of the valve bodies 47 and holding the adjusted degrees of opening compared to the case where the pressure of the pump P is utilized.

In the examples according to the first embodiment and the second embodiment having been described, the adjustment of the supply pressures of the ink performed by adjusting the degrees of opening of the valve bodies 47 is performed during cleaning. However, this is not limiting. The adjustment of the supply pressure of the ink may be performed while waiting for printing. Furthermore, the adjustment of the supply pressures of the ink performed by adjusting the degrees of opening of the valve bodies 47 may be performed at both time of cleaning and time of printing.

Variations

The exemplified forms and the embodiments having been described can be varied in a variety of manners. Specific forms of variations are exemplified as follows. Two or more of the forms arbitrarily selected from among the following examples and the above-described forms can be appropriately combined as long as no conflict occurs between the selected two or more forms.

1. Although a serial scan head in which the carriage 18 on which the liquid discharge head 20 is mounted repeatedly reciprocates in the X direction is described as the example according to the above-described embodiments, the invention can be applied also to a line scan head in which liquid discharge heads 20 are arranged throughout the width of the medium 11.

2. Although the liquid discharge head 20 of a piezoelectric method that utilizes piezoelectric elements applying mechanical vibration to pressure chambers is described as the example according to the above-described embodiments, a liquid discharge head of a thermal method that utilizes heating elements generating bubbles in pressure chambers by heating may be used.

3. The liquid discharge device 10 described as the example according to the above-described embodiments can be used for any of a variety of apparatuses such as facsimile machines and copiers other than apparatuses dedicated to printing. Furthermore, application of the liquid discharge device 10 according to the invention is not limited to printing. For example, a liquid discharge device that discharges liquid of colorant is used as any of manufacturing devices that form color filters of liquid crystal displays, organic electroluminescent (EL) displays, field-emission displays (FEDs) and so forth. Furthermore, a liquid discharge device that discharges a solution of a conductive material are used as any of manufacturing devices that form wiring and electrodes of wiring substrates. Furthermore, a liquid discharge device is used as any of chip manufacturing devices that discharge solutions of biological organic matter as a type of liquid.

What is claimed is:

1. A method of controlling a liquid discharge device, wherein the liquid discharge device includes a liquid discharge unit configured to discharge from a nozzle liquid supplied from at least one supply channel, and at least one valve body configured to open/close the at least one supply channel, and wherein the method includes a first control step that causes a pressure to be applied to the liquid so as to supply the liquid to the at least one supply channel, and a second control step that causes an external force to operate the at least one valve body operable in accordance with a pressure on a downstream side of the at least one valve body so as to adjust and hold a degree of opening of the at least one valve body in a range between a closed state and a full-open state, wherein the liquid discharge device further includes a flexible film that operates the at least one valve body, wherein the flexible film has a first surface that defines a portion of the at least one supply channel downstream of the at least one valve body and a second surface opposite to the first surface, and wherein the at least one valve body operable by deformation of the flexible film occurring in accordance with a differential pressure between a pressure on the first surface side and a pressure on the second surface side is caused to be operated by deformation of the flexible film occurring due to an external force applied from the second surface side.

2. The method according to claim 1, wherein the at least one supply channel includes a plurality of supply channels, wherein the at least one valve body includes a plurality of valve bodies, and each of the plurality of valve bodies is provided for a corresponding one of the plurality of supply channels, and wherein the first control is separately performed on each of the plurality of supply channels, and the second control is separately performed on each of the plurality of supply channels.

3. The method according to claim 2, wherein the second control for the plurality of valve bodies is simultaneously performed.

4. The method according to claim 2, wherein the external force in the second control is a pressure of air applied by a pump, and wherein, in the second control, the degrees of opening of the plurality of valve bodies are separately adjusted by varying the pressure of the pump in accordance with respective target values of supply pressures of the liquid.

5. The method according to claim 4, wherein a common air channel is connected to the pump, branch air channels respectively corresponding to the plurality of valve bodies are branched from the common air channel, and each of the branch air channels is provided with a corresponding one of solenoid valves, and wherein, in the second control, the solenoid valves each adjust the pressure applied by the pump for a corresponding one of the branch air channels so as to adjust the degree of opening of a corresponding one of the plurality of valve bodies.

6. The method according to claim 5, wherein a buffer chamber is provided in the common air channel, wherein the second control includes closing the solenoid valves and driving the pump so as to store the pressure of the air in the buffer chamber, and opening the solenoid valves so as to adjust the degrees of opening of the plurality of valve bodies by the pressure of the air stored in the buffer chamber.

7. A method of controlling a liquid discharge device, wherein the liquid discharge device includes a liquid discharge unit configured to discharge from a nozzle liquid supplied from at least one supply channel, and at least one valve body configured to open/close the at least one supply channel, and wherein the method includes a first control step that causes a pressure to be applied to the liquid so as to supply the liquid to the at least one supply channel, and a second control step that causes an external force to operate the at least one valve body operable in accordance with a pressure on a downstream side of the at least one valve body so as to adjust and hold a degree of opening of the at least one valve body in a range between a closed state and a full-open state, wherein the at least one supply channel includes a plurality of supply channels, wherein the at least one valve body includes a plurality of valve bodies, and each of the plurality of valve bodies is provided for a corresponding one of the plurality of supply channels, wherein the first control is separately performed on each of the plurality of supply channels, and the second control is separately performed on each of the plurality of supply channels, and wherein the second control for the plurality of valve bodies is simultaneously performed.

8. The method according to claim 7, wherein the external force in the second control is a pressure of air applied by a pump, and wherein, in the second control, the degrees of opening of the plurality of valve bodies are separately adjusted by varying the pressure of the pump in accordance with respective target values of supply pressures of the liquid.

9. The method according to claim 8, wherein a common air channel is connected to the pump, branch air channels respectively corresponding to the plurality of valve bodies are branched from the common air channel, and each of the branch air channels is provided with a corresponding one of solenoid valves, and wherein, in the second control, the solenoid valves each adjust the pressure applied by the pump for a corresponding one of the branch air channels so as to adjust the degree of opening of a corresponding one of the plurality of valve bodies.

10. The method according to claim 9, wherein a buffer chamber is provided in the common air channel, wherein the second control includes closing the solenoid valves and driving the pump so as to store the pressure of the air in the buffer chamber, and opening the solenoid valves so as to adjust the degrees of opening of the plurality of valve bodies by the pressure of the air stored in the buffer chamber.

* * * * *